US011280287B1

(12) United States Patent
Dudar et al.

(10) Patent No.: US 11,280,287 B1
(45) Date of Patent: Mar. 22, 2022

(54) DIAGNOSTIC METHOD FOR PRESSURE-LESS FUEL TANK

(71) Applicant: Ford Global Technologies, LLC, Dearborn, MI (US)

(72) Inventors: Aed Dudar, Canton, MI (US); Dennis Yang, Canton, MI (US); Daniel Frank Cragel, Livonia, MI (US); Russell Randall Pearce, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/074,854

(22) Filed: Oct. 20, 2020

(51) Int. Cl.
*F02D 41/22* (2006.01)

(52) U.S. Cl.
CPC ..... *F02D 41/22* (2013.01); *F02D 2041/225* (2013.01); *F02D 2200/0602* (2013.01); *F02D 2250/31* (2013.01)

(58) Field of Classification Search
CPC ..... F02D 41/22; F02D 2041/225; F02D 2250/31; F02D 2200/0602; B60K 15/03504; B60K 2015/03105; B60K 2015/03052; F02M 37/0082; B65D 88/62
See application file for complete search history.

(56) References Cited

U.S. PATENT DOCUMENTS 3,693,825 A 9/1972 Richman
3,917,117 A * 11/1975 Plotsky ..... B65D 88/66 222/94
4,880,135 A 11/1989 Neou
6,412,476 B1 7/2002 Thompson et al.
6,446,614 B1 * 9/2002 Matsuoka ..... F02D 29/06 123/516
6,681,789 B1 * 1/2004 Moulis ..... B60K 15/03504 137/14
2003/0235741 A1 * 12/2003 Richardson ..... H01M 8/04007 429/433
2006/0130568 A1 * 6/2006 Ishii ..... F02M 25/0827 73/114.39
2009/0090724 A1 * 4/2009 Childress ..... B64D 37/06 220/560.01
2013/0032672 A1 * 2/2013 Fenton ..... B64F 1/28 244/135 R
2018/0244148 A1 * 8/2018 Arras ..... F02M 25/0836

FOREIGN PATENT DOCUMENTS

JP 2000170609 A 6/2000
JP 3790017 B2 6/2006

* cited by examiner

*Primary Examiner* — George C Jin
(74) *Attorney, Agent, or Firm* — Geoffrey Brumbaugh; McCoy Russell LLP

(57) ABSTRACT

Systems and methods are presented herein for detecting a degradation condition in a variable volume device of a fuel tank of a vehicle. In one example, the issues described above may be addressed by a diagnostic method for a vehicle with a valve and a fuel tank having a variable volume device internal to the tank, comprising: operating the fuel tank over a diurnal cycle; and differentiating between degradation of the fuel tank and the variable volume device based on a fuel tank pressure at a plurality of different valve conditions; and indicating the differentiated degradation.

19 Claims, 9 Drawing Sheets

DIAGNOSTIC METHOD FOR PRESSURE-LESS FUEL TANK

FIELD

The present description relates generally to methods and systems for managing pressure in a vehicle fuel tank, and more specifically, for detecting degradations in a pressure management system.

BACKGROUND/SUMMARY

Some vehicles such as plug-in hybrid vehicles (PHEVs) have sealed fuel tanks. The tanks are structured to withstand the variations in pressure during diurnal temperature cycles. When hot ambient temperature occurs, the tank's internal pressure may be relatively high. To avoid a release of pressurized evaporative emissions during refueling, an evaporative emission control (EVAP) system is operated to depressurize the tank, such as before refueling. However, the depressurization time may be long, which may be frustrating for operators waiting outside the car to refuel. In addition, the extra hardware used to seal and depressurize the fuel tank adds cost to the system. One approach to reducing the depressurization time and cost is to use a sealed but "pressure-less" fuel tank with a built-in variable volume device (e.g., a bellows) that expands and contracts to relieve vacuum and pressure buildups, thereby eliminating pressurization hardware and reducing costs (U.S. Pat. Nos. 6,681,789; 3,693,825; JP3790017).

However, the inventors herein have recognized potential issues with such systems. As the bellows vents via an atmospheric port, a degradation in the bellows may result in undetected increased evaporative emissions. In one example, the issues described above may be addressed by a diagnostic method for a vehicle with a valve and a fuel tank having a variable volume device internal to the tank, comprising: operating the fuel tank over a diurnal cycle; and differentiating between degradation of the fuel tank and the variable volume device based on a fuel tank pressure at a plurality of different valve conditions; and indicating the differentiated degradation. In this way, it is possible to identify, from the fuel tank pressure, whether degradation is due to the variable volume device, or the fuel tank.

In another approach, the issues described above may be addressed by a diagnostic method for a vehicle with a valve and a fuel tank having a variable volume device internal to the tank, comprising: closing a valve coupled to a variable volume device positioned within an interior of the fuel tank; measuring a first pressure of the fuel tank after the valve is closed; determining a first degradation condition in the fuel tank based on the measured first fuel tank pressure; opening the valve coupled to the variable volume device; measuring a second pressure of the fuel tank after the valve is open; determining a second degradation condition in the variable volume device based on the second measured fuel tank pressure. In this way, a diagnostic routine for degradations in bellows may be provided that will meet current and future degradation detection regulations, thereby facilitating a transition from higher-cost pressurized fuel tank systems to less costly pressure-less fuel tank systems. In some examples, such an approach can avoid utilizing an additional vacuum pump.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for diagnosing a fuel system. In one example, approaches are described for diagnosing degradations in a variable volume device, such as bellows, of a Non Integrated Refueling Canister Only System (NIRCOS) fuel tank of a PHEV vehicle.

As disclosed herein, a degradation condition in the bellows may be identified by a diagnostic routine that adjusts a valve coupled to the bellows to an open position and draws a vacuum into the fuel tank. As a pressure in the fuel tank decreases, the bellows expands. When the bellows is fully expanded, the valve coupled to the bellows may be adjusted to a closed position, and the vacuum of the fuel tank may be monitored by a pressure sensor. A detected bleedup of air from the bellows to the fuel tank may be used to determine whether a degradation condition exists in the bellows or in the fuel tank, as well as a size of the degradation. In one example, the degradation may be a small hole, where air may leak slowly from the bellows to the fuel tank or from the fuel tank to the bellows. In other examples, the degradation may be a larger hole, where air may leak quickly from the bellows to the fuel tank or from the fuel tank to the bellows. In this way, degradation-detection regulations on pressure-less fuel tanks with variable volume devices may be met, and the variable volume devices may be implicated as a source of a degradation and serviced accordingly, while preserving the fuel tank. An advantage of this solution is that the variable volume device may be checked for degradations with the introduction of a new sealing valve, while an existing fuel tank pressure sensor may be used to assess the fuel tank, thus minimizing requirements for new hardware.

Figure 1:
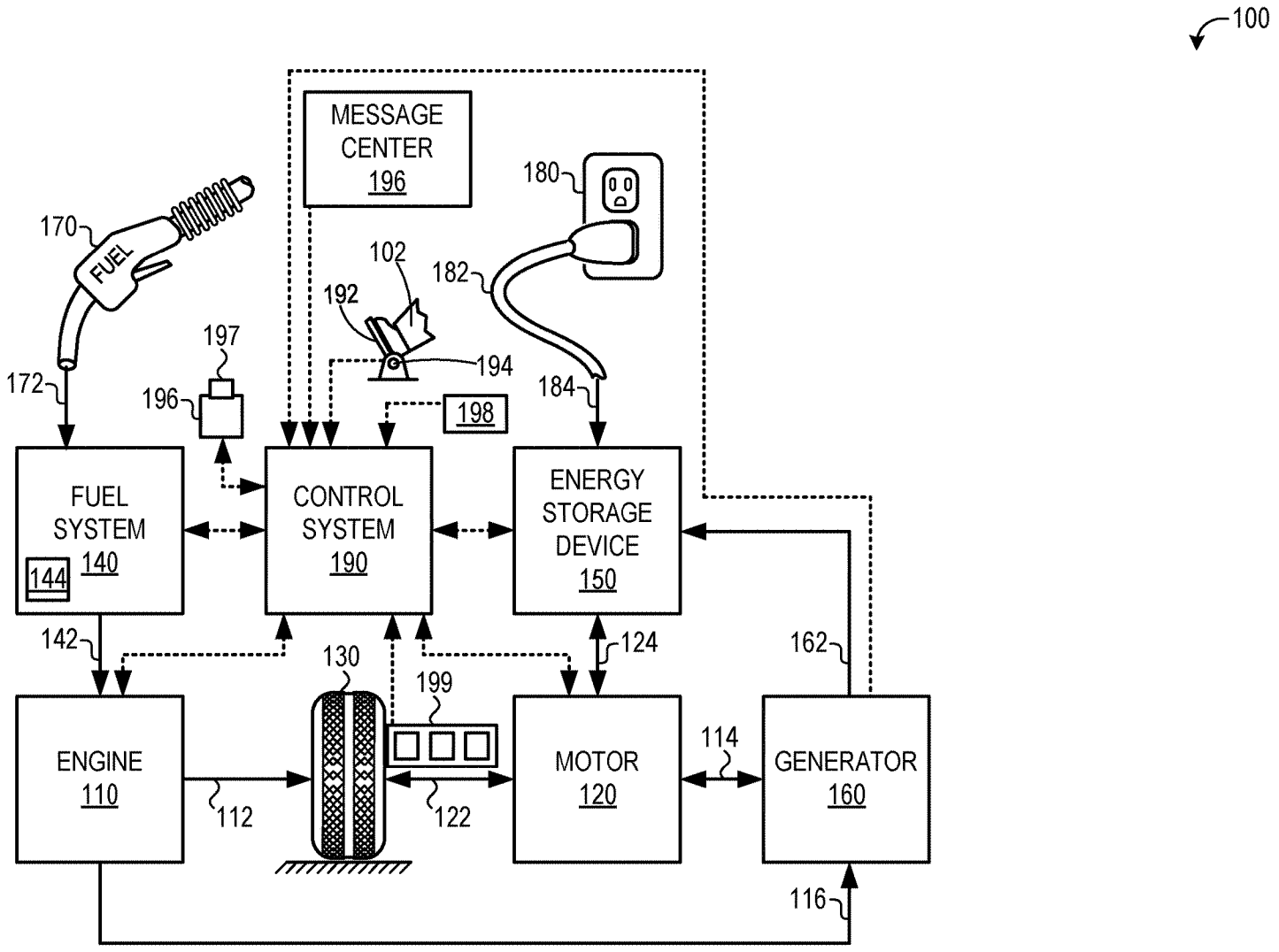
FIG. 1 schematically shows an example vehicle propulsion system.
Figure 2:
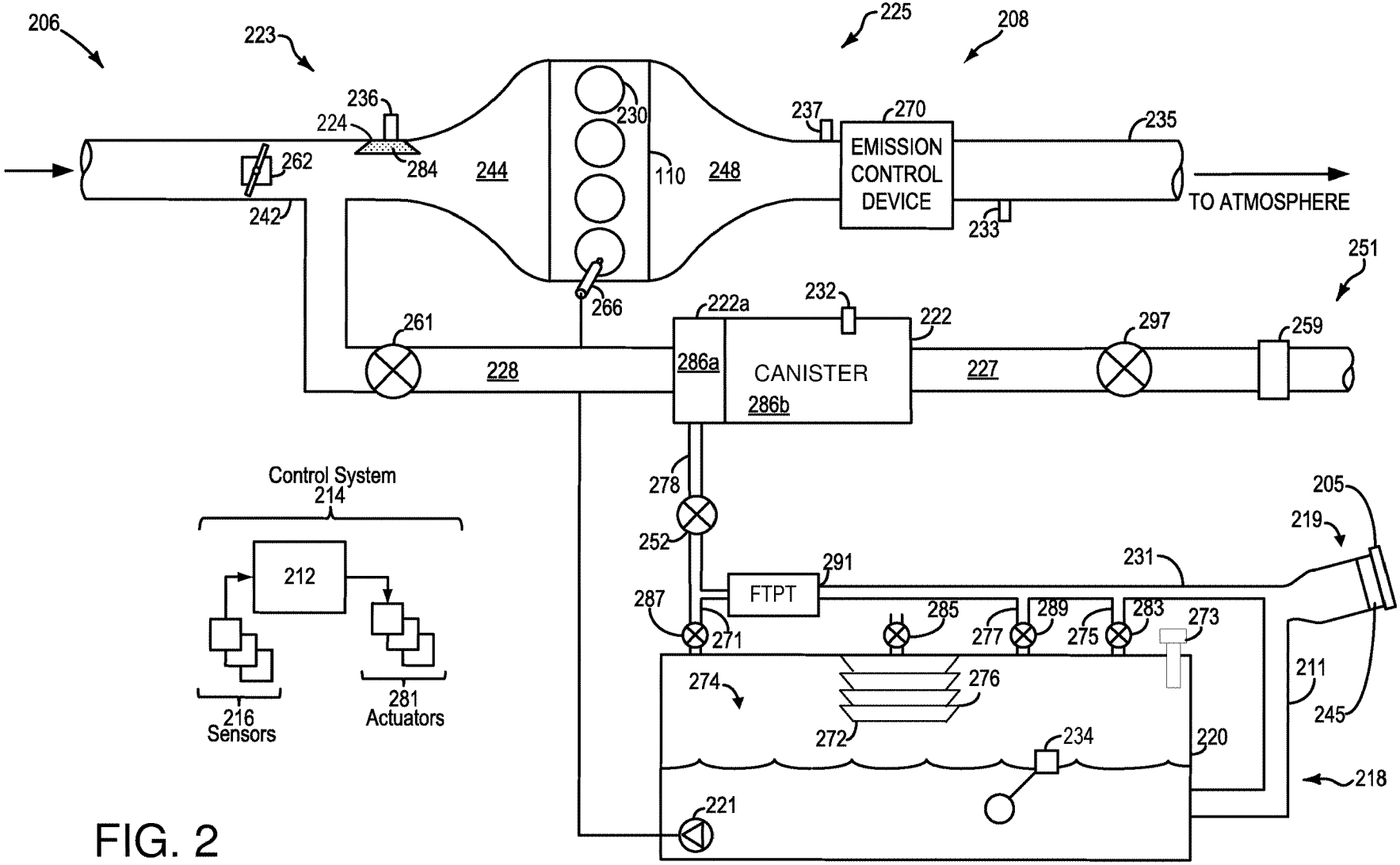
FIG. 2 schematically shows an example vehicle system with a fuel system and an EVAP system.
Figure 3:
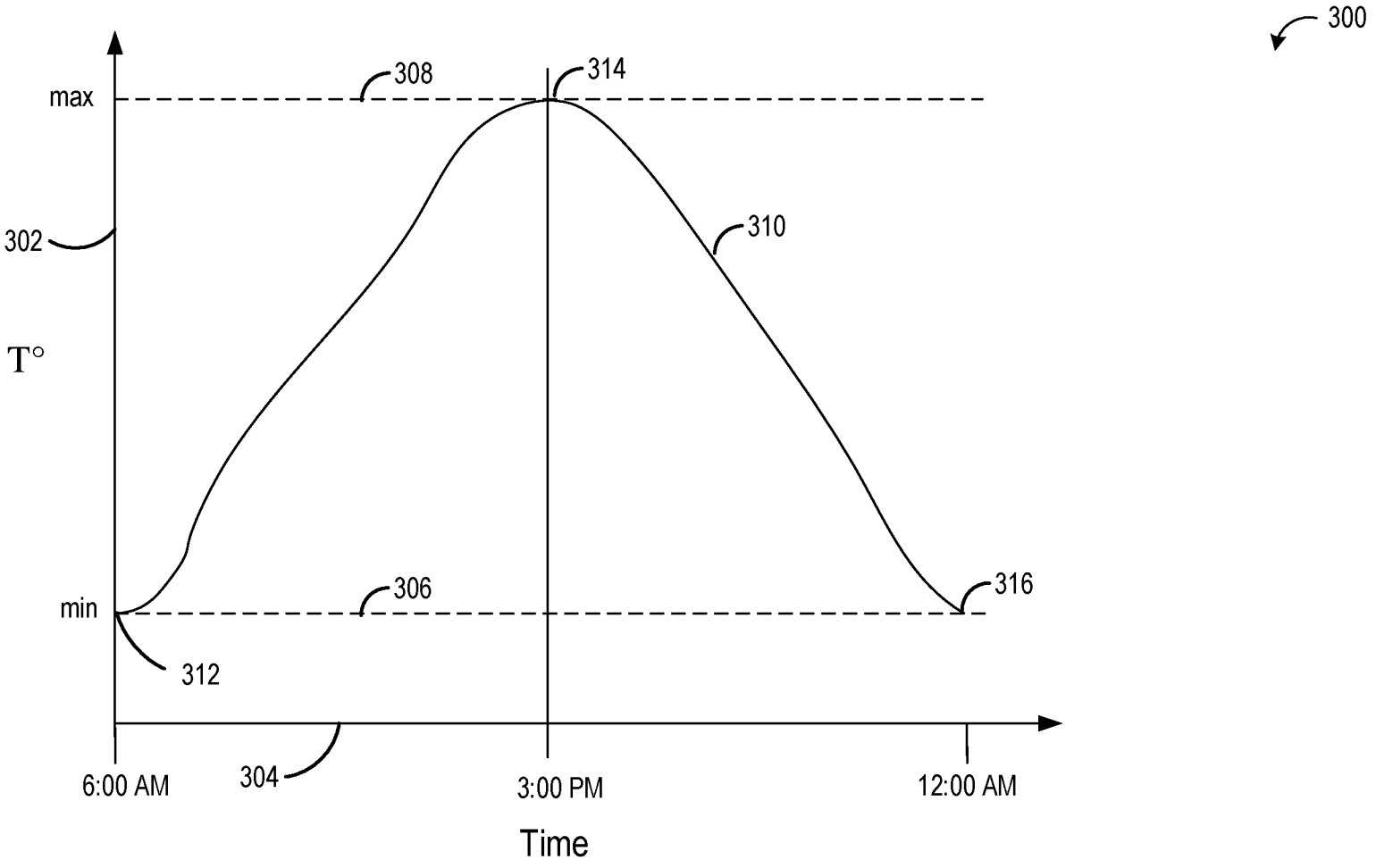
FIG. 3 is a graph depicting a change in an internal temperature of a fuel tank over the course of one day.

An example vehicle propulsion system is depicted in FIG. 1. The vehicle propulsion system may include an engine system, an emissions control system, and a fuel system with a variable volume device installed in a fuel tank, as shown in FIG. 2. The internal pressure of a fuel tank of the fuel system may increase as a function of fuel tank temperature, which may vary over a daily period as shown in FIG. 3.

Degradations in the bellows may be diagnosed depending on a level of fuel and a state of the bellows, as shown in FIGS. 4A-4D. A pressure-less fuel tank with a built-in variable volume device (e.g., the bellows) may be designed with less structural reinforcements than a fuel tank designed to withstand a high pressure, as shown in FIGS. 5A and 5B. Degradations in the variable volume device and/or in the pressure-less fuel tank may be diagnosed via a method described in FIGS. 6 and 7. The steps of the method described in FIGS. 6 and 7 may be timed as shown in the timing diagrams shown in FIGS. 8 and 9. In this way, pressure-less fuel tanks used in PHEVs may be maintained in full compliance with emissions regulations and degradations in a fuel tank and/or a variable volume device of a fuel tank may be identified rapidly and efficiently.

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. As will be described by the process flow of FIG. 6, control system 190 may receive sensory feedback information from one or more of engine 110, motor 120, fuel system 140, energy storage device 150, and generator 160. Further, control system 190 may send control signals to adjust a state of one or more of engine 110, motor 120, fuel system 140, energy storage device 150, and generator 160 responsive to this sensory feedback. For example, adjusting a state of the fuel system 140 may include adjusting an actuator of the fuel system (e.g., a fuel tank intake valve, bellows sealing valve, etc.) Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be manually actuated or pressed by a vehicle operator to initiate refueling. For example, as described in more detail below, in response to the vehicle operator actuating refueling button 197, a fuel tank in the vehicle may be depressurized so that refueling may be performed.

In an alternative example, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a vehicle system 206. The vehicle system 206 includes an engine system 208 coupled to an emissions control system 251 and a fuel system 218. Emission control system 251 includes a fuel vapor container or canister 222 which may be used to capture and store fuel vapors. In some examples, vehicle system 206 may be a hybrid electric vehicle system. The fuel system 218 may be the same as or similar to the fuel system 140 of vehicle propulsion system 100 of FIG. 1.

The engine system 208 may include an engine 110 having a plurality of cylinders 230. The engine 110 includes an engine air intake 223 and an engine exhaust 225. The engine air intake 223 includes a throttle 262 in fluidic communication with engine intake manifold 244 via an intake passage 242. Further, engine air intake 223 may include an air box and filter (not shown) positioned upstream of throttle 262. The engine exhaust system 225 includes an exhaust manifold 248 leading to an exhaust passage 235 that routes exhaust gas to the atmosphere. The engine exhaust system 225 may include one or more exhaust catalyst 270, which may be mounted in a close-coupled position in the exhaust. One or more emission control devices may include a three-way catalyst, lean NOx trap, diesel particulate filter, oxidation catalyst, etc. It will be appreciated that other components may be included in the engine such as a variety of valves and sensors.

An air intake system hydrocarbon trap (AIS HC) 224 may be placed in the engine air intake 223. For example, hydrocarbon trap 224 may be positioned in the air box (not shown) or in the engine intake manifold 244 of engine 110 to adsorb fuel vapors emanating from unburned fuel in the intake manifold, puddled fuel from injectors and/or fuel vapors in crankcase ventilation emissions during engine-off periods. The AIS HC may include a stack of consecutively layered polymeric sheets impregnated with HC vapor adsorption/desorption material. Alternately, the adsorption/desorption material may be filled in the area between the layers of polymeric sheets.

The adsorption/desorption material 284 may include one or more of carbon, activated carbon, zeolites, or any other HC adsorbing/desorbing materials. When the engine is operational causing an intake manifold vacuum and a resulting airflow across the AIS HC, the trapped vapors are passively desorbed from the AIS HC and combusted in the engine. Thus, during engine operation, intake fuel vapors are stored and desorbed from AIS HC 224. In addition, fuel vapors stored during an engine shutdown can also be desorbed from the AIS HC during engine operation. In this way, AIS HC 224 may be continually loaded and purged, and the trap may reduce evaporative emissions from the engine air intake 223 even when engine 110 is shut down and stopped rotating. In some examples, one or more temperature sensor(s) 236 may be positioned (embedded) in the AIS HC trap in order to monitor adsorption and desorption of fuel vapors. Briefly, as fuel vapor is adsorbed by the AIS HC trap, heat may be generated. Conversely, as fuel vapor is desorbed from the trap, heat may be consumed. As such, adsorption and desorption of fuel vapor by the AIS HC trap may be monitored and estimated based on temperature changes within the AIS HC trap. In some examples, as will be discussed in further detail below, temperature changes indicated in the AIS HC trap during a refueling event may be indicative of a canister purge valve (CPV) 261 that is degraded.

Fuel system 218 may include a fuel tank 220. In one example, the fuel tank 220 is a sealed NIRCOS fuel tank. NIRCOS fuel tanks may be made of heavy steel to withstand pressures and vacuum builds from diurnal temperature cycles. With NIRCOS fuel tanks, the canister is sized to absorb refueling and depressurization vapors, while running loss and diurnal vapors are contained inside the fuel tank. In hot climates, significant pressures can build up inside the fuel tank, which can cause an unwanted pressurized release of fuel vapor when opening a fuel door. However, some "pressure-less" NIRCOS fuel tanks use variable geometry in the form of a bellows to maintain internal pressure at atmospheric condition, thereby eliminating pressurization hardware and reducing costs. As described in greater detail below, as a pressure in the fuel tank increases, the bellows may collapse, allowing air inside the bellows to escape to atmosphere, thereby increasing the available volume inside the fuel tank and lowering the pressure in the fuel tank.

The fuel tank 220 may be coupled to a fuel pump system 221, which may include one or more pumps for pressurizing fuel delivered to the injectors of engine 110, such as the example injector 266 shown. In an embodiment, the fuel pump system 221 is arranged inside the fuel tank 220. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to an EVAP system 251 which includes a fuel vapor canister 222 via vapor recovery line 231, before being purged to the engine air intake 223. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

In one example, the vehicle is a PHEV and fuel tank 220 is a Non Integrated Refueling Canister Only System (NIRCOS) sealed pressure-less fuel tank with a variable volume device, such as bellows, 272 installed inside the tank. Other variable volume devices such as a spring-loaded piston may be used. Further other configurations are also possible. An example NIRCOS pressure-less fuel tank is described in greater detail below in relation to FIG. 5B. One end of the bellows 272 may be affixed to the roof of the fuel tank 220, while an opposite end of the bellows 272 may extend into a vapor space 274 of the fuel tank 220. The bellows 272 may include a plurality of overlapping bellows sections 276, such that the bellows 272 may expand into the vapor space 274 up to a maximum expansion, or the bellows 272 may collapse to a minimum expansion (e.g., against the roof of the fuel tank 220). In one example, the bellows may be designed to be fully expanded or close to fully expanded at atmospheric pressure. The fuel tank 220 may include an in-tank pressure sensor 273 that is communicably coupled to the controller 212, whereby the controller 212 may measure an internal pressure of the fuel tank 220. It should be appreciated that the components used to depressurize the fuel tank, such as the locking solenoid, refuel button, tank pressure control valve, high pressure FTPT, high pressure refuel valve, associated software, etc., increase a cost of a fuel system. An advantage of including a bellows is that by maintaining an atmospheric pressure in the fuel tank, some the abovementioned components may be eliminated or replaced with low-pressure alternatives, which may reduce a cost of the fuel system.

In some examples, recovery line 231 may be coupled to a fuel filler system 219. In some examples, fuel filler system may include a fuel cap 205 for sealing off the fuel filler system from the atmosphere. Refueling system 219 is coupled to fuel tank 220 via a fuel filler pipe or neck 211. Further, in some examples, one or more fuel tank vent valves may be positioned in conduits 271, 277, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 275 may include a GVV 283, and conduit 277 may include a fill limit venting valve (FLVV) 289. In addition, the fuel tank 220 may include a bellows sealing valve 285, which may allow air from the atmosphere to enter the bellows 272, and/or air from the bellows 272 to be released to the atmosphere. As air enters the bellows 272, a volume of the bellows 272 may increase such that the bellows 272 expands into the vapor space 276, without allowing the air to pass from the sealed bellows 272 to the vapor space 274. Alternatively, as air exits the bellows 272 into the atmosphere via the bellows sealing valve 285, the volume of the bellows 272 may decrease, and the bellows may collapse towards an uninflated position against the roof of the fuel tank 220. The function of the bellows 272 and the use of the bellows sealing valve 285 is described in greater detail below.

Refueling system 219 may include refueling lock 245. In some examples, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. However, a depressurization of a NIRCOS fuel tank has a duration (e.g., 15 seconds) that may frustrate operators waiting to open the fuel door. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some examples, refueling lock 245 may be a filler pipe valve located at a mouth of fuel filler pipe 211. In such examples, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some examples, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In examples where refueling lock 245 is locked using an electrical mechanism, refueling lock 245 may be unlocked by commands from controller 212, for example, when a fuel tank pressure decreases below a pressure threshold. In examples where refueling lock 245 is locked using a mechanical mechanism, refueling lock 245 may be unlocked via a pressure gradient, for example, when a fuel tank pressure decreases to atmospheric pressure.

Emissions control system 251 may include one or more emissions control devices, such as one or more fuel vapor canisters 222 filled with an appropriate adsorbent **286*b*, where the canisters are configured to temporarily trap fuel vapors (including vaporized hydrocarbons) during fuel tank refilling operations and "running loss" (that is, fuel vaporized during vehicle operation). In one example, the adsorbent 286***b* used is activated charcoal. Emissions control system 251 may further include a canister ventilation path or vent line 227 which may route gases out of the canister 222 to the atmosphere when storing, or trapping, fuel vapors from fuel system 218.

Canister 222 may include a buffer 222*a* (or buffer region), each of the canister and the buffer comprising the adsorbent. As shown, the volume of buffer 222*a* may be smaller than (e.g., a fraction of) the volume of canister 222. The adsorbent 286*a* in the buffer 222*a* may be same as, or different from, the adsorbent in the canister (e.g., both may include charcoal). Buffer 222*a* may be positioned within canister 222 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine. One or more temperature sensors 232 may be coupled to and/or within canister 222. As fuel vapor is adsorbed by the adsorbent in the canister, heat is generated (heat of adsorption). Likewise, as fuel vapor is desorbed by the adsorbent in the canister, heat is consumed. In this way, the adsorption and desorption of fuel vapor by the canister may be monitored and estimated based on temperature changes within the canister.

Vent line 227 may also allow fresh air to be drawn into canister 222 when purging stored fuel vapors from fuel system 218 to engine intake 223 via purge line 228 and purge valve 261. For example, purge valve 261 may be normally closed but may be opened during certain conditions so that vacuum from engine intake manifold 244 is provided to the fuel vapor canister for purging. In some examples, vent line 227 may include an air filter 259 disposed therein upstream of a canister 222.

In some examples, the flow of air and vapors between canister 222 and the atmosphere may be regulated by a canister vent valve 297 coupled within vent line 227. When included, the canister vent valve 297 may be a normally open valve, so that fuel tank isolation valve 252 (FTIV) may control venting of fuel tank 220 with the atmosphere. FTIV 252 may be positioned between the fuel tank and the fuel vapor canister 222 within conduit 278. FTIV 252 may be a normally closed valve, that when opened, allows for the venting of fuel vapors from fuel tank 220 to fuel vapor canister 222. Fuel vapors may then be vented to atmosphere, or purged to engine intake system 223 via canister purge valve 261.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not combusting air and fuel), wherein the controller 212 may open isolation valve 252 while closing canister purge valve (CPV) 261 to direct refueling vapors into canister 222 while preventing fuel vapors from being directed into the intake manifold. However, in some examples, if the CPV is degraded, then refueling vapors may be directed from the fuel tank to the intake manifold 244, as the path from the fuel tank to the intake manifold may represent a pathway of least resistance for fuel vapors in the event of a CPV that is degraded. As such, fuel vapors that reach the intake manifold 244 may be adsorbed by the AIS HC trap 224 positioned in the engine air intake 223.

As another example, the fuel system may be operated in a refueling mode (e.g., when fuel tank refueling is requested by a vehicle operator), wherein the controller 212 may open isolation valve 252, while maintaining canister purge valve 261 closed, to depressurize the fuel tank before allowing enabling fuel to be added therein. As such, isolation valve 252 may be kept open during the refueling operation to allow refueling vapors to be stored in the canister. After refueling is completed, the isolation valve 252 may be closed.

As yet another example, the fuel system may be operated in a canister purging mode (e.g., after an emission control device light-off temperature has been attained and with the engine combusting air and fuel), wherein the controller 212 may open canister purge valve 261 while closing isolation valve 252. Herein, the vacuum generated by the intake manifold of the operating engine may be used to draw fresh air through vent 227 and through fuel vapor canister 222 to purge the stored fuel vapors into intake manifold 44. In this mode, the purged fuel vapors from the canister are combusted in the engine. The purging may be continued until the stored fuel vapor amount in the canister is below a threshold.

In some examples where the vehicle is a PHEV, when powered by an electric motor (e.g., the motor 120 of vehicle propulsion system 100 of FIG. 1), the engine 110 may not be in operation. When the engine 110 is not in operation, the FTIV 252 may remain closed, whereby pressurized air and/or fuel vapors are not purged into the engine air intake 223 and the engine 110, and the fuel tank 220 may be sealed. As a result, a pressure of the fuel tank 220 (e.g., within the vapor space 274) may increase over the course of a day due to diurnal temperature cycles. For example, in early morning, the fuel tank 220 may be at atmospheric pressure, while in the late afternoon the fuel tank 220 may have a pressure that is above atmospheric pressure. In the evening, the pressure of the fuel tank 220 may decrease to atmosphere as the ambient temperature decreases.

To reduce the increase in the pressure of the fuel tank 220 due to diurnal temperature cycles, the bellows sealing valve 285 may be adjusted to an open state, whereby air may be released from the bellows 272 into the air. Thus, as pressure builds within the vapor space 274 of the fuel tank 220, the bellows 272 is allowed to collapse as air inside the bellows 272 is released, decreasing the pressure in the vapor space. As the pressure inside the fuel tank 220 decreases at the end of the diurnal temperature cycle (e.g., at night), the bellows 272 may expand, drawing air into the bellows 272 via the open bellows sealing valve 285. In this way, the pressure inside the fuel tank 220 may be maintained within a desired range (e.g., at or near atmospheric pressure) without opening the FTIV 252 to release fuel vapors from the vapor space 274 into the canister 222.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include exhaust gas sensor 237 located upstream of the emission control device 270, temperature sensor 233, pressure sensor 291, and canister temperature sensor 232. Other sensors such as pressure, temperature, air/fuel ratio, and composition sensors may be coupled to various locations in the vehicle system 206. As another example, the actuators may include throttle 262, fuel tank isolation valve 252, canister purge valve 261, and canister vent valve 297. The control system 214 may include a controller 212. The controller may receive input data from the various sensors, process the input data, and trigger the actuators in response to the processed input data based on instruction or code programmed therein corresponding to one or more routines. An example control routine is described herein with regard to FIG. 5, FIG. 6, and FIG. 8.

In some examples, the controller may be placed in a reduced power mode or sleep mode, wherein the controller maintains essential functions, and operates with a lower battery consumption than in a corresponding awake mode. For example, the controller may be placed in a sleep mode following a vehicle-off event in order to perform a diagnostic routine at a duration after the vehicle-off event. The controller may have a wake input that allows the controller to be returned to an awake mode based on an input received from one or more sensors. For example, the opening of a vehicle door may trigger a return to an awake mode.

Undesired evaporative emissions detection routines may be intermittently performed by controller 212 on fuel system 218 and/or EVAP system 251 to confirm that undesired evaporative emissions are not present in the fuel system and/or evaporative emissions system. As such, evaporative emissions detection routines may be performed while the engine is off (engine-off test) using engine-off natural vacuum (EONV) generated due to a change in temperature and pressure at the fuel tank following engine shutdown and/or with vacuum supplemented from a vacuum pump (not depicted in FIG. 2). Alternatively, evaporative emissions detection routines may be performed while the engine is running by operating a vacuum pump and/or using engine intake manifold vacuum. In some configurations, a canister vent valve (CVV) 297 may be coupled within vent line 227. CVV 297 may function to adjust a flow of air and vapors between canister 222 and the atmosphere. The CVV may also be used for diagnostic routines. When included, the CVV may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the CVV may be opened to allow a flow of fresh air to strip the fuel vapors stored in the canister. In some examples, CVV 297 may be a solenoid valve wherein opening or closing of the valve is performed via actuation of a canister vent solenoid. In particular, the canister vent valve may be a normally open valve that is closed upon actuation of the canister vent solenoid. In some examples, CVV 297 may be configured as a latchable solenoid valve. In other words, when the valve is placed in a closed configuration, it latches closed without requiring additional current or voltage. For example, the valve may be closed with a 100 ms pulse, and then opened at a later time point with another 100 ms pulse. In this way, the amount of battery power used to maintain the CVV closed is reduced. In particular, the CVV may be closed while the vehicle is off, thus maintaining battery power while maintaining the fuel emissions control system sealed from atmosphere. Some evaporative emissions detection routines may be used to identify a degradation in the fuel system 218 by determining a pressure of the fuel system 218 via the pressure sensor 291. For example, the FTIV 252 may be adjusted to a closed position whereby pressurized air from the vapor space 274 may be released into the vapor recovery line 231, thereby allowing the pressure sensor 291 to measure the pressure of the fuel system 218. A first output of the pressure sensor 291 may be compared with a second output of the pressure sensor 291 at a later time, and a difference between the first output and the second output may indicate a degradation in the fuel system 218. However, a problem with current degradation detection routines is that the pressure sensor 291 may not be able to determine whether a detected degradation is in the fuel tank 220 or in the bellows 272. Therefore, an additional diagnostic routine may be desired to distinguish between a degradation in a bellows and a degradation in a fuel tank.

One example method for determining a degradation condition in the bellows 272 (e.g., as distinguished from a degradation condition in the fuel tank 220) involves adjusting the FTIV 252 to a closed position, and generating a target vacuum in the fuel tank 220. For example, a target vacuum may be generated in the fuel tank 220 by a vacuum pump of the fuel system 218 (not depicted in FIG. 2). In one example, the target vacuum may be an amount of negative pressure that corresponds to a fully expanded bellows 272, without overinflating the bellows 272 to a point where damage may be caused to the bellows 272. The target vacuum may be determined as a result of offline studies.

As the vacuum is generated in the fuel tank 220, the bellows sealing valve 285 may be opened, thereby allowing the bellows 272 to expand to a fully expanded state as air enters the bellows 272 from the atmosphere. Fully expanding the bellows 272 may expose a degradation that may be covered up by the overlapping bellows sections 276. If the target vacuum is achieved with the bellows sealing valve 285 open, it may be concluded that no degradations are present in the fuel tank 220 or the bellows 272. Alternatively, if the target vacuum is not maintained (e.g., that the in-tank pressure sensor 273 registers an increase in pressure over time), it may be concluded that a degradation condition exists in either the bellows 272 or the fuel tank 220. For example, air from the atmosphere may be bleeding into the vapor space 274 of the fuel tank 220 via a degradation in a structure of the fuel tank 220, or air from the atmosphere may be bleeding into the vapor space 274 of the fuel tank 220 through the open valve 285 and a degradation in the bellows 272. Further, if the target vacuum is not maintained, a rate of pressure change may be used to estimate a size of the degradation. For example, if the rate of pressure change is high, the size of the degradation may be large. If the rate of pressure change is low, the size of the degradation may be small.

If it is determined that a degradation condition exists in either the fuel tank 220 or the bellows 272, a further diagnostic routine may be introduced to determine whether the degradation is in the fuel tank 220 or the bellows 272. Once the target vacuum is achieved and the bellows 272 has fully expanded, the bellows sealing valve 285 may be adjusted to a closed position, thereby sealing the bellows 272 and preventing air from entering or exiting the bellows 272 to atmosphere. Once the bellows 272 is sealed, a bleedup analysis may be performed again (e.g., by the controller 212) using the in-tank pressure sensor 273 to determine whether air from the bellows 272 is leaking into the vapor space 274. If a target vacuum is maintained, it may be concluded that no degradation condition exists in the fuel tank 220, and therefore the degradation is in the bellows 272. For example, if there is a degradation in the fuel tank 220, air may enter the fuel tank 220 and prevent the target vacuum from being maintained. Alternatively, if there is a degradation in the bellows 272 while the bellows sealing valve 285 is closed, the pressure of the fuel tank 220 may not change, since the pressure is simply adjusted between the bellows 272 and the vapor space 274 with no air being introduced into either the bellows 272 or the fuel tank 220. Thus, by measuring a vacuum inside the fuel tank 220 under different configurations of valve positions, a degradation condition in the bellows 272 may be distinguished from a degradation condition in the fuel tank 220. As a result, the bellows 272 may be serviced and replaced, while preserving the fuel tank 220. An example method for determining a location of a degradation condition in the fuel tank 220 or the bellows 272 is described in greater detail below in reference to FIG. 6.

Referring now to FIG. 3, a temperature graph 300 shows a plot 310 depicting a change in an internal temperature of a fuel tank of a vehicle over the course of one day. The fuel tank may be the same as or similar to the fuel tank 220 of the fuel system 218 of FIG. 2. The temperature inside the fuel tank may be measured via a temperature sensor arranged within the fuel tank. Temperature graph 300 includes a vertical axis 302 showing temperature, a horizontal axis 304 showing time, a minimum temperature threshold 306, and a maximum temperature threshold 308.

At point 312, plot 310 indicates a minimum temperature of the fuel tank at 6:00 AM. During a diurnal temperature cycle, plot 310 shows an increase in the temperature of the fuel tank to a maximum temperature at point 314 of plot 310 over a first duration from 6:00 AM to 3:00 PM, during which time an ambient temperature increases. Over a second duration from 3:00 PM to 12:00 AM, plot 310 shows a decrease in the temperature of the fuel tank from the maximum temperature at point 314 back to the minimum temperature at point 316.

As the temperature of the fuel tank increases, a corresponding pressure may build up inside the fuel tank. For example, at 6:00 AM when the temperature inside the fuel tank is at a minimum, the pressure inside the fuel tank may be the same as the atmospheric pressure outside the fuel tank. At 3:00 PM when the temperature inside the fuel tank is at a maximum, the pressure inside the fuel tank may be the higher than the pressure outside the fuel tank. As a result of a difference between the pressure inside of the fuel tank and the pressure outside the fuel tank, a controller of the vehicle (e.g., the controller 212 of control system 214 of FIG. 2) may lock a refueling lock (e.g., the refueling lock 245 of FIG. 2) of a filler system of the fuel tank, whereby an operator is prevented from opening a fuel cap of the fuel tank and being exposed to pressurized fuel vapors inside the fuel tank.

Figure 4A:
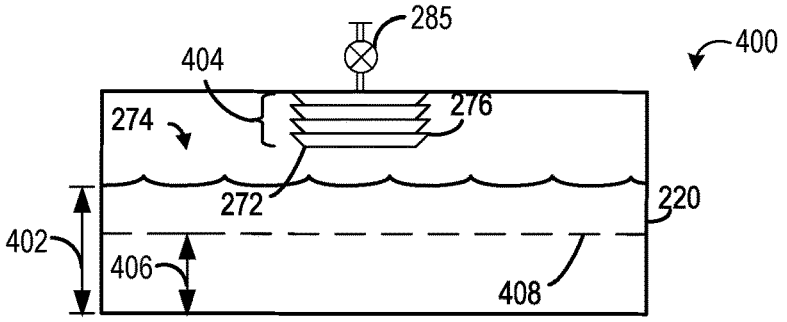
FIGS. 4A, 4B, 4C, and 4D show examples of a fuel tank with a bellows, in expanded and collapsed states, where the bellows has a degradation.

Referring now to FIGS. 4A, 4B, 4C, and 4D, examples of the fuel tank 220 and the bellows 272 are shown, where the bellows 272 is in different expanded and collapsed states, and where a degradation condition exists in the bellows 272. In FIG. 4A, example view 400 shows the bellows 272 of the fuel tank 220 collapsed to a minimum bellows expansion 404 against a roof of the fuel tank 220, where a volume of the bellows 272 is minimized. In a fully collapsed state, a pressure of the bellows 272 may also be minimized. Example view 400 shows fuel tank 220 with a fuel depth 402, where the fuel depth 402 may indicate a high volume of fuel. In one embodiment, the fuel depth 402 may be measured by a fuel level sensor arranged inside the fuel tank 220, such as the fuel level sensor 234 of fuel system 218.

For example, the fuel depth 402 may be above a threshold depth 406, as indicated by a bellows depth line 408, where the threshold depth corresponds to a lowest point of the bellows 272 when the bellows 272 is fully expanded. Thus, the bellows 272 cannot be expanded to a maximum bellows expansion (e.g., a maximum volume) without coming in contact with the fuel. Because the bellows 272 is not fully expanded, a degradation in one of the overlapping bellows sections (e.g., on a side of the bellows) may not be exposed to air in the vapor space 474, and therefore the degradation may not be detected by the degradation detection routine disclosed herein.

Figure 4B:
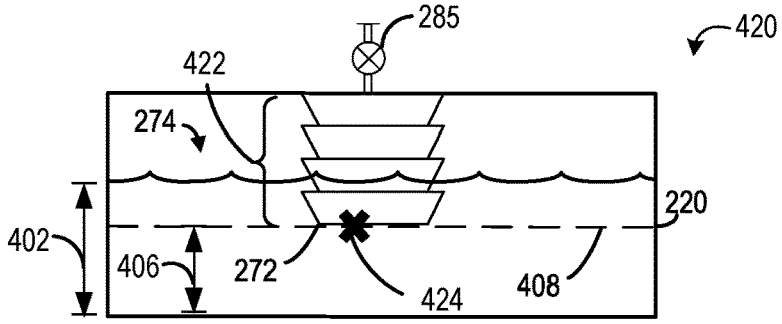
Figure 5B:
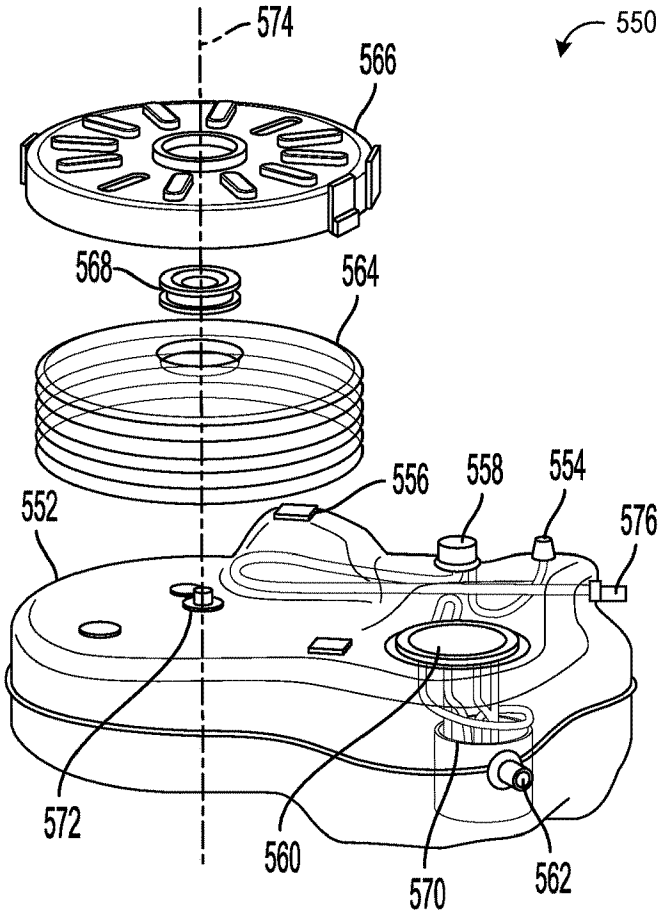
FIGS. 5A and 5B are images of a fuel tank with and without a bellows.
Figure 5A:
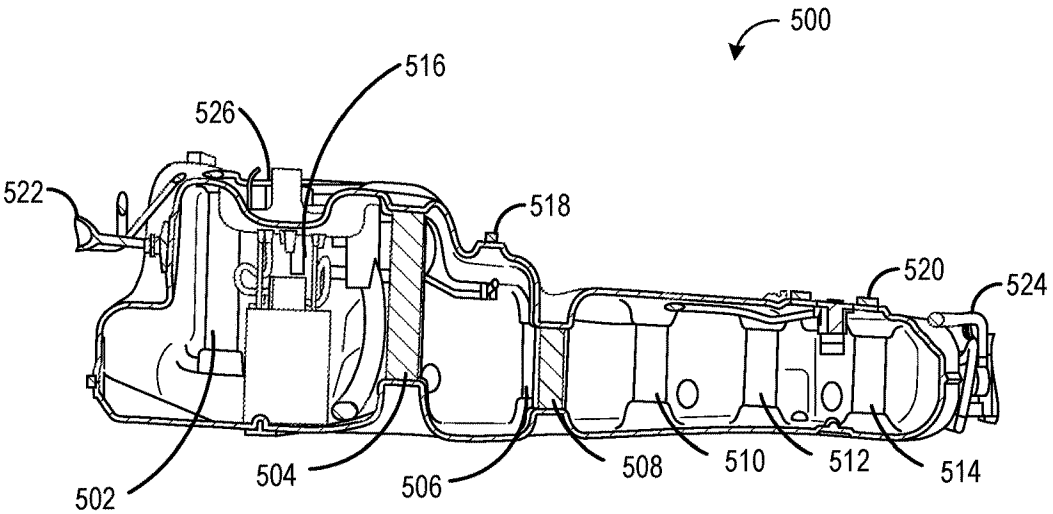

In contrast, FIG. 4B shows an example view 420 where the bellows 272 is expanded to a maximum bellows expansion 422, where the lowest point of the bellows 272 reaches the bellows depth line 408 at the threshold depth 406. As described above, the degradation detection routine disclosed herein relies on the bellows 272 being fully expanded, as otherwise a degradation in one of the overlapping bellows sections 276 may not be exposed. Further, the degradation detection routine disclosed herein relies on the bellows 272 not being in contact with a volume of fuel in the fuel tank 220, as if a fully expanded bellows extends below the level of the fuel, a degradation 424 on a bottom portion of the bellows 272 would not be exposed to the air. For example, if the degradation detection routine disclosed herein were carried out in a situation such as that shown by FIG. 4B where the degradation 424 is below the fuel depth 402, the fuel may prevent air from inside the bellows 272 from bleeding out through the degradation 424, and the degradation 424 may remain undetected. Thus, if the fuel depth 402 is above the threshold depth 406, the bellows 272 cannot be fully expanded without coming in contact with the fuel, and the degradation detection routine may not identify the degradation 424. Alternatively, if the fuel depth 402 is below the threshold depth 406, the bellows 272 can be fully expanded without coming in contact with the fuel, and the degradation detection routine may identify the degradation 424. As a result, having a fuel depth below the threshold depth 406 may be a precondition for running the degradation detection routine disclosed herein.

Figure 4C:
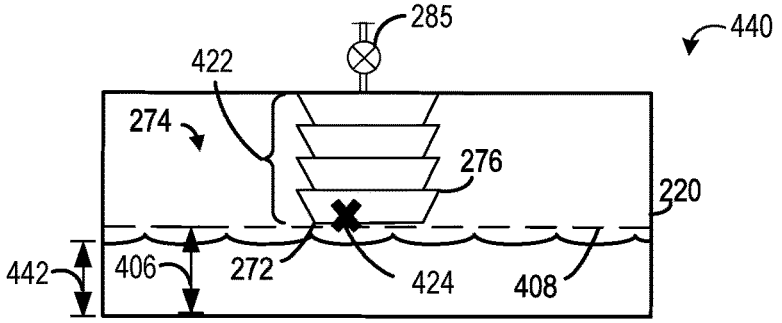

Referring now to FIG. 4C, an example view 440 shows fuel tank 220 with a fuel depth 442, where the fuel depth 442 may indicate a low volume of fuel. For example, the fuel depth 442 may be lower than the threshold depth 406, as indicated by the bellows depth line 408, such that the lowest point of the bellows 272 is exposed to the air in the vapor space 474 when the bellows is expanded to a maximum bellows expansion 422. As a result, any liquid fuel that has leaked into the bellows 272 is allowed to drip back into the fuel tank, to expose the degradation to air, whereby air inside the bellows 272 is able to bleed out into the vapor space 274 via the degradation 424 on a bottom portion of the bellows 272 during the degradation detection routine. Thus, while FIG. 4B represents a situation in which the degradation detection routine may not detect a degradation, FIG. 4A represents a situation in which the degradation detection routine may detect a degradation.

Figure 4D:
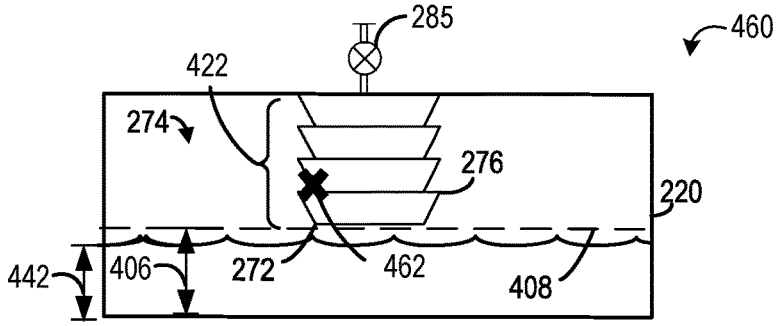

In FIG. 4D, an example view 460 shows fuel tank 220 with the fuel depth 442 indicating a low volume of fuel as in FIG. 4C. As described above, the fuel depth 442 may be lower than the threshold depth 406, as indicated by the bellows depth line 408, such that the lowest point of the bellows 272 is exposed to the air in the vapor space 474 when the bellows is expanded to a maximum bellows expansion 422. Example view 460 shows a degradation 462 in one of the overlapping bellows sections 276. In contrast to FIG. 4A, where the degradation 462 would not be exposed to the air due to the collapsed state of the bellows 272, in FIG. 4D, the degradation 462 is exposed to the air in the vapor space 274 due to the bellows 272 being fully expanded. As a result, air inside the bellows 272 is able to bleed out into the vapor space 274 via the degradation 462 in a side of the bellows 272 during the degradation detection routine. Thus, while FIG. 4A represents a situation in which the degradation detection routine may not detect a degradation, FIG. 4D represents a situation in which the degradation detection routine may detect a degradation.

Referring now to FIG. 5A, an example NIRCOS fuel tank 500 of a PHEV vehicle is shown. The NIRCOS fuel tank may be the same as or similar to the fuel tank 144 of vehicle propulsion system 100 of FIG. 1. The fuel tank 500 may be made of a heavy material (e.g., metal) capable of withstanding a high pressure. In an embodiment, the fuel tank 500 is made of steel.

The NIRCOS fuel tank 500 may include a fuel pump system 516 arranged inside the fuel tank 500. The fuel pump system 516 may be the same as or similar to the fuel pump system 221 of the fuel system 218 of FIG. 2, and may accessed via a fuel pump opening 526. The fuel pump system 516 may include an in-tank fuel pump, a fuel filter, a fuel level gauge, a fuel feed line and a fuel return line, etc., and may pump fuel from the fuel tank 500 to one or more cylinders of an engine, such as the engine 110 of FIG. 2. The fuel tank 500 may include one or more vent valves 518, which release air and/or fuel vapors to decrease a pressure inside the fuel tank 500. In an embodiment, the one or more vent valves 518 may be coupled to a conduit leading to a vapor canister, such as the vapor canister 222 of FIG. 2. As described above in reference to FIG. 2, the one or more fuel vent valves 518 may allow a fuel vapor canister of the emissions control system to be maintained at a low pressure or vacuum without increasing the fuel evaporation rate from the tank. In an embodiment, the one or more vent valves 518 include one or more grade vent valves (GVV) and a fill limit venting valve (FLVV).

The fuel tank 500 may also include a pressure sensor 520, which may measure the pressure inside the fuel tank 500. NIRCOS fuel tank 500 may include one or more standoffs, such as standoffs 502, 504, 506, 508, 510, 512, and 514, which may provide a structural reinforcement to the fuel tank 500. For example, the standoffs 502-514 may aid the fuel tank 500 in withstanding a pressure that builds up within the fuel tank 500 as a result of diurnal temperature cycles. In one example, the internal pressure of the fuel tank 500 may range from −2 psi (e.g., negative pressure or vacuum) to 5 psi (e.g., a high pressure). The number and arrangement of standoffs included in the fuel tank 500 may vary depending on a type of the PHEV vehicle.

Fuel may be introduced into the NIRCOS fuel tank 500 via a fuel filler pipe 522. The fuel filler pipe may be the same as or similar to the fuel filler pipe 211 of FIG. 2. The fuel tank 500 may also include a fuel level indicator 524, which may output a measurement of a level and/or volume of fuel to a controller of the vehicle.

Referring now to FIG. 5B, an exploded view of a pressure-less NIRCOS fuel tank 550 is shown. In contrast to the fuel tank 500, the fuel tank 550 includes a bellows 564 arranged inside the fuel tank 550, where a pressure of the fuel tank 550 may be maintained below a threshold pressure by adjusting a volume of the bellows 274. The bellows 274 may be the same as or similar to the bellows 272 of fuel system 218 of FIG. 2, and the fuel tank 550 may be the same as or similar to the fuel tank 144 of vehicle propulsion system 100 of FIG. 1 and/or the fuel tank 220 of fuel system 218 of FIG. 2. In contrast to the fuel tank 500, the pressure-less fuel tank 550 may be made of a relatively light material that is not capable of withstanding a high pressure. In an embodiment, the fuel tank 500 is made of plastic.

For example, a volume of the fuel tank 550 may comprise a first volume of liquid fuel, and a second volume of vapor space. The vapor space may be the same as or similar to the vapor space 274 of fuel system 218 of FIG. 2. As fuel is consumed by an engine (e.g., the engine 110 of the vehicle propulsion system 100 of FIG. 1) the first volume of liquid fuel may decrease and the second volume of vapor space may increase. As the second volume of vapor space increases, the pressure of the fuel tank 550 may be subject to greater variation over the course of a diurnal temperature cycle, whereby the pressure of the fuel tank 550 may increase due to a hot ambient temperature and decrease due to a cool ambient temperature. To maintain the pressure of the fuel tank 550 below a threshold pressure, the bellows 564 may be arranged inside the fuel tank 550 such that the bellows 564 occupies a portion of the second volume of vapor space. The bellows 272 may be affixed to an interior surface of the fuel tank 550 (e.g., the roof) and may be sealed, whereby air from the vapor space may not enter the bellows and air from the bellows may not enter the vapor space. Further, the bellows 564 may be permitted to collapse as the air in the vapor space expands due to increased temperatures, and expand as the air in the vapor space contracts due to decreased temperatures. In this way, a pressure increase in the fuel tank 550 is offset by a corresponding decrease in the volume of the bellows 564, and the pressure of the fuel tank 550 may be maintained within a desired range.

The fuel tank 550 may include a molded casing 552, with a pressure sensor 554, a touchpoint (e.g., a pad) 556, one or more vent valves 558, a fuel pump system 570 accessible via a fuel pump opening 560, and a fuel filler pipe 562, similar to the pressure sensor 520, the one or more vent valves 518, the fuel pump system 516, the fuel pump opening 526, and a fuel filler pipe 522 of fuel tank 500 described above in relation to FIG. 5A. The fuel tank 550 may include a load port 576 for venting the fuel tank (e.g., with a passive vent valve such as the GVV 283 or FLVV 289 of FIG. 2). The bellows 564 may be attached to an upper surface of the fuel tank 550 via a bellows cap 566, which may be coaxially aligned with the bellows 564 around a common axis 574, with a bellows seal 568 separating the bellows cap 566 from the bellows 272. The fuel tank 550 may include a bellows sealing valve 572 positioned on the fuel tank 550 at a location of a central opening of the bellows 564 where the molded casing 552 intersects with the common axis 574. As described above in relation to FIG. 2, the bellows sealing valve 572 may be adjusted to an open position whereby air may enter the bellows 564 from atmosphere, or adjusted to a closed position to perform a diagnostic routine to determine a degradation condition of the bellows 564. For example, as described in greater detail below in relation to FIG. 6, a vacuum may be introduced into the fuel tank 550 to expand the bellows 564 to a maximum expansion, after which the bellows sealing valve 572 may be adjusted to a closed position to determine via a bleedup analysis whether air from the bellows 564 may be leaking into the vapor space of the fuel tank 550.

An advantage of the pressure-less NIRCOS fuel tank 550 over the NIRCOS fuel tank 500 is that by reducing an amount of internal pressure that the NIRCOS fuel tank 550 is subject to (e.g., via the bellows 564), the NIRCOS fuel tank 550 may be constructed out of a lighter and/or less costly material (e.g., such as plastic) than the NIRCOS fuel tank 500. Further, the standoffs 502, 504, 506, 508, 510, 512, and 514 of the NIRCOS fuel tank 500 may be rendered unnecessary and therefore may be eliminated in the NIRCOS fuel tank 550. As a result, a cost of the NIRCOS fuel tank 550 may be lower than a cost of the NIRCOS fuel tank 500. However, an impediment to widespread adoption of the pressure-less NIRCOS fuel tank 550 is that an evaporative emissions detection routine (also referred to herein as a degradation detection routine) of the NIRCOS fuel tank 550 may not be sufficient to diagnose a degradation in the bellows 564, and a new and/or additional evaporative emissions or degradation detection routine may be desired, such as the degradation detection method described below in FIG. 6.

Figure 6:
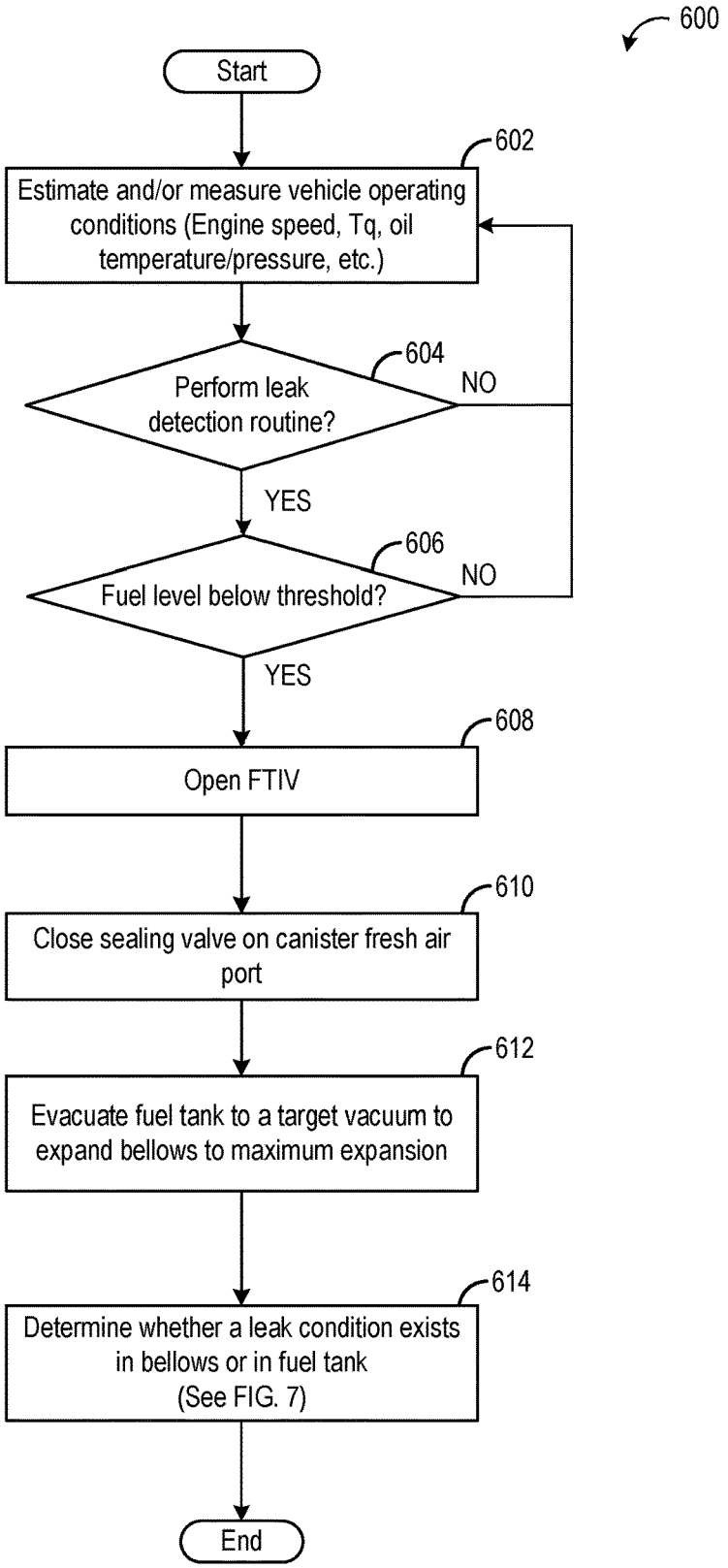
FIGS. 6 and 7 show an exemplary method describing a process whereby a degradation condition of a bellows may be distinguished from a degradation condition of a fuel tank.

Referring now to FIG. 6, an exemplary method 600 is shown for determining whether a degradation condition of a bellows or a fuel tank exists within a fuel system of a HEV vehicle. The bellows and the fuel tank of the fuel system of the vehicle may be the same as or similar to the bellows 272 of the fuel tank 220 of the fuel system 218 of FIG. 2 and/or the bellows 564 of the fuel tank 550 of FIG. 5B. Instructions for carrying out method 600 may be executed by a controller (e.g., the controller 212 of control system 214 of FIG. 2) based on instructions stored on a memory of the controller and in conjunction with signals received from sensors of the vehicle propulsion system, such as the sensors described above in relation to the vehicle propulsion system 100 of FIG. 1. The controller may employ actuators of the vehicle propulsion system in accordance with the method 600 described below.

As those of ordinary skill in the art will understand, the functions represented by the flow chart blocks may be performed by software and/or hardware. Depending upon the particular processing strategy, such as event-driven, interrupt-driven, etc., the various functions may be performed in an order or sequence other than illustrated in the figure. For example, one or more conditions for implementing method 600 (e.g., steps 604 and 606) may be performed in a reverse order in some examples (e.g., where step 606 is performed prior to step 604). Similarly, one or more steps or functions may be repeatedly performed, although not explicitly illustrated. In one embodiment, the functions illustrated are primarily implemented by software, instructions, or code stored in a computer readable storage medium and executed by one or more microprocessor-based computers or controllers to control operation of the vehicle.

At 602, method 600 includes estimating and/or measuring vehicle operating conditions. Vehicle operating conditions may be estimated based on one or more outputs of various sensors of the vehicle (e.g., such as oil temperature sensors, engine speed or wheel speed sensors, torque sensors, etc., as described above in reference to vehicle propulsion system 100 of FIG. 1). Vehicle operating conditions may include engine speed and load, vehicle speed, transmission oil temperature, exhaust gas flow rate, mass air flow rate, coolant temperature, coolant flow rate, engine oil pressures (e.g., oil gallery pressures), operating modes of one or more intake valves and/or exhaust valves, electric motor speed, battery charge, engine torque output, vehicle wheel torque, etc. Estimating and/or measuring vehicle operating conditions may include determining whether the HEV vehicle is being powered by an engine or an electric motor (e.g., the engine 110 or the electric motor 120 of vehicle propulsion system 100 of FIG. 1). Estimating and/or measuring vehicle operating conditions may further include determining a state of a fuel system of the vehicle, such as measuring a pressure of the fuel system, determining a state of one or more valves of the fuel system (e.g., a refueling/fuel intake valve, bellows sealing valve), etc.

At 604, method 600 includes determining whether to perform a degradation detection routine on a fuel system of the vehicle. For example, method 600 may include determining when a predetermined duration has been exceeded (e.g., 24 hours, one week, etc.), and in response thereto performing the degradation detection routine at a key-on event. Additionally and/or alternatively, a performance of the degradation detection routine may be conditioned upon a state of the fuel system. For example, a degradation detection routine may be performed upon initiation of operation of an electric motor when a fuel intake valve (e.g., FTIV 252 of FIG. 2) is closed, thereby sealing the fuel tank and exposing the fuel tank to pressure changes as a result of changes in ambient temperature. In one example, the degradation detection routine is performed if it is detected by a controller both that the FTIV valve has been closed and that the degradation detection routine has not been performed within the last 24 hours. In other examples, the degradation detection routine may be conditioned upon a different state of operation of the vehicle being achieved, or a combination of states of operation, or a combination of states of operation and a maintenance and/or diagnostics schedule.

If the degradation detection routine is determined not to be performed at 604, method 600 proceeds back to 602. If it is determined that the degradation detection routine is to be performed at 604, method 600 proceeds to 606. At 606, method 600 includes determining whether a fuel level is below a threshold level, and in response thereto performing the degradation detection routine. For example, performing the degradation detection routine may depend on the level of fuel in the fuel tank being low enough to allow the bellows to fully expand without coming in contact with liquid fuel in the fuel tank, as described in relation to FIGS. 4A-4D (e.g., the threshold depth 406 of FIGS. 4A-4D). In one example, the threshold level is 40% of a capacity of the fuel tank. The threshold level may vary depending on the type, model, or volume of the bellows of the fuel tank. Further, instructions stored in memory may include receiving an output of a fuel level sensor (e.g., the fuel level sensor 234 of fuel system 218 of FIG. 2), an in-tank pressure sensor (e.g., the pressure sensor 273 of fuel system 218 of FIG. 2) and/or other sensors of the fuel system, and in response thereto, performing the degradation detection routine as described below via instructions for sending a signal to one or more actuators, including a fuel intake valve and/or bellows sealing valve (e.g., the FTIV 252 and bellows sealing valve 285 of fuel system 218 of FIG. 2).

In some examples, determining whether a level of fuel in the fuel tank is below a threshold level may occur after determining whether to perform the degradation detection routine, while in other examples, determining whether a level of fuel in the fuel tank is below a threshold level may occur prior to determining whether to perform the degradation detection routine. Thus, while in FIG. 6 determining whether to perform the degradation detection routine is shown at 604 as a precondition to determining whether a level of fuel in the fuel tank is below a threshold level at 606, in other examples step 606 may be performed prior to and as a precondition to step 604 without departing from the scope of this disclosure. In one example, the performance of the degradation detection routine is performed when both a predetermined threshold duration (e.g., 24 hours) has been exceeded and the fuel in the fuel tank is below a threshold level, but not when the predetermined threshold duration has been exceeded and the fuel in the fuel tank is not below a threshold level or when the predetermined threshold duration has not been exceeded and the fuel in the fuel tank is below a threshold level.

If it is determined at 606 that the fuel level is not below a threshold level, method 600 proceeds back to 602. Alternatively, if it is determined at 606 that the fuel level is below a threshold level, method 600 proceeds to 608. At 608, method 600 includes opening a refueling valve of the fuel tank (e.g., the FTIV 252 of the fuel system 218 of FIG. 2). Once the refueling valve has been opened at 608, method 600 proceeds to 610. At 610, method 600 includes closing a sealing valve on a fresh air port of a fuel vapor canister, such as the fuel be for canister 222 of the fuel system 218 of FIG. 2, whereby air from the atmosphere is prevented from entering the fuel system. Upon opening one or more refueling valves of the fuel tank and closing the sealing valve on the fresh air port of a fuel vapor canister, a vacuum may be induced in the fuel tank.

At 612, method 600 includes evacuating the fuel tank to a target vacuum. In one example, the target vacuum may be achieved by operating a vacuum pump coupled to the fuel system to draw air from a vapor space of the fuel tank (e.g., the vapor space 274 of the fuel system 218 of FIG. 2) out of the fuel tank via the open refueling valve until an output of an in-tank pressure sensor indicates a negative pressure. As the target vacuum is achieved, air may be drawn into the bellows through a bellows sealing valve (which is maintained open except when closed as part of method 600 as described below), thereby expanding the bellows to a maximum expansion. The target vacuum may be a negative pressure sufficient to draw air from the bellows into the vapor space in the event of a degradation in the bellows, but not sufficient to cause damage to the bellows. In one example, the target vacuum may be predetermined based on one or more offline studies. In one example, the target vacuum is −10 InH20.

At 614, method 600 includes determining whether a degradation condition exists in the bellows or in the fuel tank, as described below in relation to FIG. 7.

Figure 7:
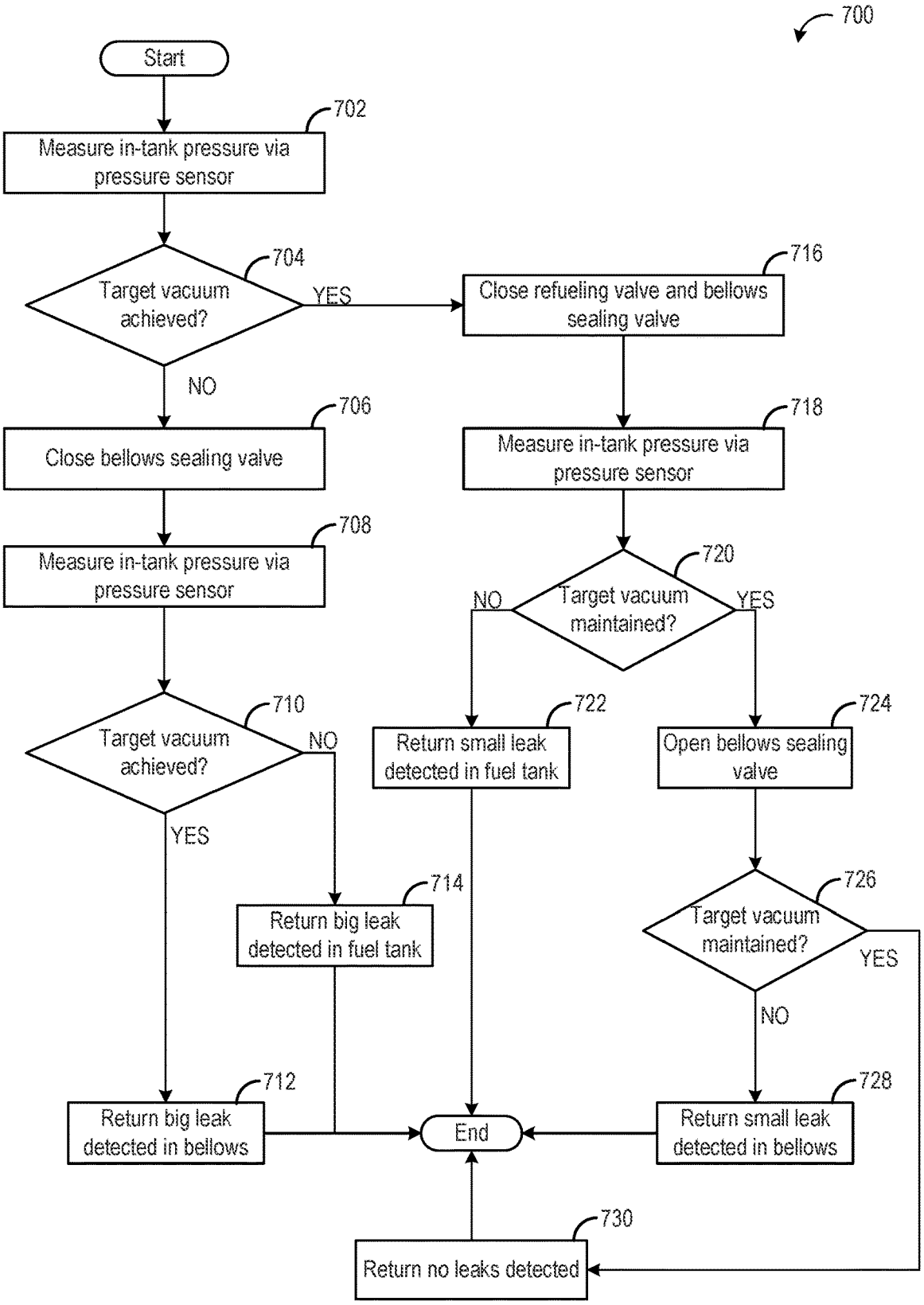

Turning to FIG. 7, an exemplary method 700 is shown for determining, within a fuel system of a HEV vehicle, whether a degradation condition exists in the bellows or in the fuel tank, and further distinguishing a degradation in the bellows from a degradation in the fuel tank. The bellows and the fuel tank of the fuel system of the vehicle may be the same as or similar to the bellows 272 of the fuel tank 220 of the fuel system 218 of FIG. 2 and/or the bellows 564 of the fuel tank 550 of FIG. 5B. Instructions for carrying out method 700 may be executed by a controller (e.g., the controller 212 of control system 214 of FIG. 2) based on instructions stored on a memory of the controller and in conjunction with signals received from sensors of the vehicle propulsion system, such as the sensors described above in relation to the vehicle propulsion system 100 of FIG. 1. The controller may employ actuators of the vehicle propulsion system in accordance with the method 700 described below.

Method 700 begins with the fuel tank and bellows sealing valve open, with the bellows expanded to a maximum expansion, and with the target vacuum being induced by a vacuum pump. At 702, method 700 includes measuring an in-tank pressure via a pressure sensor (e.g., the pressure sensor 273 of FIG. 2). At 704, method 700 includes determining whether the target vacuum has been achieved. For example, a first in-tank pressure measurement may be taken by the pressure, and a second in-tank pressure measurement may be taken by the pressure sensor after a duration. The first in-tank pressure measurement and the second in-tank pressure measurement may be compared to determine whether a difference exists between the first in-tank pressure measurement and the second in-tank pressure measurement. If a difference exists between the first in-tank pressure measurement and the second in-tank pressure measurement (or a third, or subsequent in-tank pressure measurement), it may be concluded that the target vacuum has not been achieved. Alternatively, if no difference exists between the first in-tank pressure measurement and the second in-tank pressure measurement, it may be concluded that the target vacuum has been achieved.

If the target vacuum is not achieved at 704, with the refueling valve and the bellows sealing valve open, it may be concluded that a large degradation exists in either the fuel tank or the bellows. Method 700 proceeds to 706, to determine whether the large degradation is in the fuel tank or in the bellows. At 706, method 700 includes closing the bellows sealing valve, thereby preventing air from entering the bellows from the atmosphere. At 708, method 700 includes measuring the in-tank pressure via the pressure sensor as described above, and at 710, method 700 includes determining whether the target vacuum is achieved with the bellows sealing valve closed. If at 710 it is determined that the target vacuum is achieved with the bellows sealing valve closed, method 700 proceeds to 712. At 712, method 700 includes returning an indication that a large degradation has been detected in the bellows. Alternatively, if at 710 it is determined that the target vacuum is not achieved, method 700 proceeds to 714. At 714, method 700 determines by logical inference that if the large degradation is not in the bellows, then the large degradation is in the fuel tank, and method 700 includes returning an indication that a large degradation has been detected in the fuel tank.

In a first example, a large degradation exists in the bellows. As the vacuum pump draws air out of the vapor space of the fuel tank to achieve the target vacuum, air enters the bellows via the open bellows sealing valve and flows through the large degradation in the bellows into the vapor space of the fuel tank. As a result, the pressure sensor detects that the target vacuum has not been achieved (e.g., a measured fuel tank pressure below a threshold pressure, such as atmospheric pressure). By closing the bellows sealing valve, air is prevented from entering the bellows and flowing through the large degradation in the bellows into the vapor space of the fuel tank. Thus, after closing the bellows sealing valve, the vacuum pump draws air out of the vapor space of the fuel tank and the pressure sensor detects that the target vacuum is achieved.

In a second example, a large degradation exists in the fuel tank. As the vacuum pump draws air out of the vapor space of the fuel tank to achieve the target vacuum, air enters the vapor space of the fuel tank from the atmosphere through the degradation. As a result, the pressure sensor detects that the target vacuum has not been achieved (e.g., a measured fuel tank pressure does not indicate a pressure below a threshold pressure). If the bellows sealing valve is closed, air continues to flow unabated into the fuel tank through the degradation, and the pressure sensor detects that the target vacuum is not achieved.

Thus, a large degradation in the bellows may be distinguished from a large degradation in the fuel tank by measuring a first pressure of the fuel tank with the bellows sealing valve open, and a second pressure of the fuel tank with the bellows sealing valve closed, and determining whether the first pressure is equal to the second pressure. If the first pressure and the second pressure are equal, the large degradation is in the fuel tank. Alternatively, if the first pressure is a positive pressure and the second pressure is a negative pressure (e.g., the target vacuum), the large degradation is in the bellows.

Returning to 704, if it is determined at 704 that the target vacuum is achieved with the refueling valve and the bellows sealing valve open, it may be concluded that no large degradation exists in either the fuel tank or the bellows. However, a small degradation may exist in either the fuel tank or the bellows. Therefore, method 700 includes additional steps to determine whether there is a small degradation, and to further distinguish between a small degradation in the fuel tank or a small degradation in the bellows.

At 704, if it is determined that the target vacuum is achieved with the refueling valve and the bellows sealing valve open, method 700 proceeds to 716. At 716, method 700 includes closing the refueling valve and the bellows sealing valve, thereby sealing the fuel tank (e.g., at the target vacuum) and the bellows such that air may not enter either the fuel tank or the bellows. At 718, method 700 includes measuring an in-tank pressure via the pressure sensor. With the fuel tank is sealed, a pressure increase (e.g., from the target vacuum) over time may indicate a small degradation in the fuel tank or the bellows.

For example, a degradation condition in the bellows would result in a flow of air from the bellows to the vapor space to equalize a pressure difference between the bellows and the fuel tank. The flow of air may result in an increase in the pressure of the fuel tank over time, which may be detected by the in-tank pressure sensor. Alternatively, if no degradation condition exists in the bellows, a flow of air from the bellows to the vapor space may not be detected by the in-tank pressure sensor. However, a degradation in the fuel tank may result in a flow of air from the atmosphere into the fuel tank, which may also be detected in the form of an increase in the pressure of the tank by the in-tank pressure sensor. Therefore, if a degradation condition is determined as a result of an increase in the pressure of the tank over time, it may not be possible to determine whether the degradation condition exists in the bellows or the fuel tank. To distinguish between a degradation condition in the bellows and a degradation condition in the fuel tank, a bleed up analysis may be performed to determine whether air from the bellows is leaking into the fuel tank.

At 720, method includes determining whether the target vacuum is maintained after closing the refueling valve and the bellows sealing valve. When the valves are closed, the pressure inside the bellows and the pressure inside the fuel tank are equal. Further, a presence of a degradation condition in the bellows may change a relative pressure difference between the bellows and the fuel tank, but the presence of the degradation condition does not change the pressure inside the fuel tank. Thus, if the target vacuum is not maintained within the sealed fuel tank, it may be concluded a degradation condition exists in the fuel tank. Therefore, if a target vacuum is not maintained at 720, method 700 proceeds to 722, where method 700 includes returning with an indication that a degradation condition has been detected in the fuel tank.

Alternatively, if a target vacuum is maintained at 720, a degradation condition may still exist in the bellows, whereby air flows from the bellows into the vapor space of the fuel tank, without affecting the pressure of the fuel tank. Therefore, if the target vacuum is maintained at 720, method 700 proceeds to 724. At 724, method 700 includes opening the bellows scaling valve, whereby air from the atmosphere may enter the bellows. At 726, method 700 includes determining whether the target vacuum has been maintained. If the target vacuum is not maintained at 726, method 700 proceeds to 728. At 728, method 700 includes returning with an indication that a small degradation is detected in the bellows. Alternatively, if the target vacuum is maintained at 726, it may be concluded that no degradation conditions exist either in the bellows or the fuel tank, and method 700 proceeds to 730. At 730, method 700 includes returning with an indication that no degradations are detected, and method 700 ends.

In this way, a degradation detection routine may be provided for a NIRCOS pressure-less fuel tank of a fuel system including a bellows, where by selectively opening and closing a refueling valve of a fuel tank and a bellows sealing valve of a fuel tank, inducing a vacuum in the fuel tank, and determining via repeated measurements whether the vacuum is maintained across various valve configurations, a degradation condition in the bellows may be detected and distinguished from a degradation condition in the fuel tank. Further, an advantage of the degradation detection routine disclosed herein is that apart from a new low pressure bellows sealing valve, the degradation detection routine may rely on existing components of the fuel system (pressure sensor, vent valves, intake valves, etc.), thus decreasing a cost of the fuel system.

Figure 8:
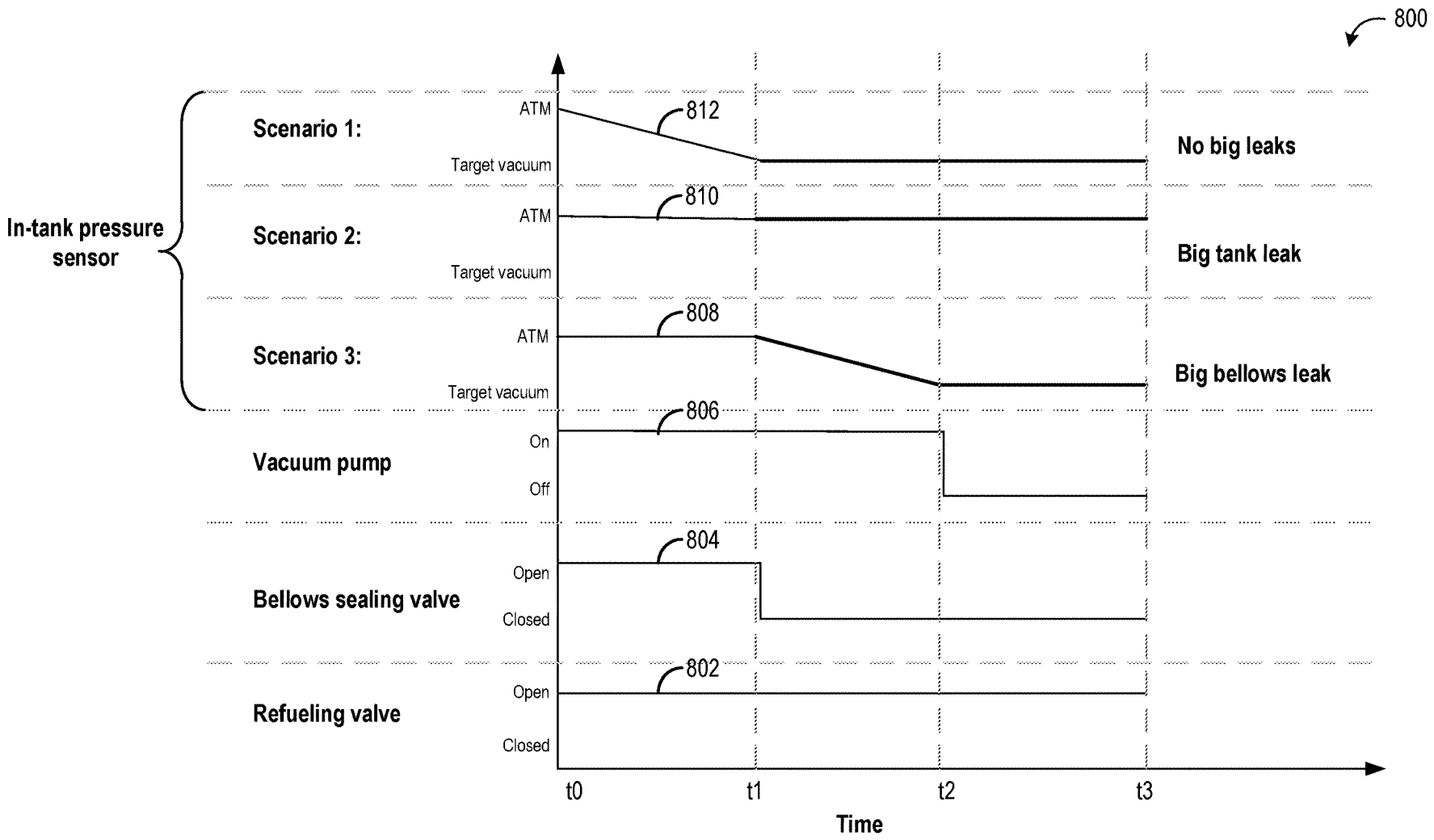
FIG. 8 is a timing diagram of a diagnostics routine for a fuel system.

Referring now to FIG. 8, a timing diagram 800 is shown that illustrates a sequence of actions performed within a diagnostic procedure for distinguishing a large degradation in a bellows from a large degradation in a fuel tank of a fuel system of a HEV vehicle. The diagnostic procedure may be the same as or similar to the procedure described above in reference to steps 702-714 of method 700. The bellows and the fuel tank of the fuel system of the vehicle may be the same as or similar to the bellows 272 of the fuel tank 220 of the fuel system 218 of FIG. 2 and/or the bellows 564 of the fuel tank 550 of FIG. 5B. Instructions for performing the actions described in method 800 may be executed by a controller (e.g., the controller 212 of control system 214 of FIG. 2) based on instructions stored on a memory of the controller and in conjunction with signals received from sensors of the vehicle propulsion system, such as the sensors described above in relation to the vehicle propulsion system 100 of FIG. 1.

Timing diagram 800 shows plots 802, 804, 806, 808, 810, and 812, which illustrate states of components of the fuel system over time. Plot 802 indicates a state of a refueling valve of the fuel system (e.g., the FTIV 252 of the fuel system 218 of FIG. 2), which may be in an OPEN position or a CLOSED position. Plot 804 indicates a state of a bellows sealing valve (e.g., the bellows sealing valve 285 of the fuel system 218 of FIG. 2), which may be in an OPEN position or a CLOSED position. Plot 806 indicates a state of a vacuum pump, which may be in an ON state or an OFF state. Plots 808, 810, and 812 show pressure measurements outputted by an in-tank pressure sensor over time (e.g., the in-tank pressure sensor 273 of the fuel system 218 of FIG. 2), where plot 812 shows pressure measurements outputted by the in-tank pressure sensor under a first scenario (e.g., no large degradations), plot 810 shows pressure measurements outputted by the in-tank pressure sensor under a second scenario (e.g., a large tank degradation), and plot 808 shows pressure measurements outputted by the in-tank pressure sensor under a third scenario (e.g., a large bellows degradation). In accordance with one example, the pressure measurements reflected in plots 808, 810, and 812 fall within a pressure range as indicated on the vertical axis, where the highest pressure reflected is an atmospheric pressure, and the lowest pressure reflected is a target vacuum (e.g., the target vacuum described in methods 600 and 700).

Plots 802, 804, 806, 808, 810, and 812 illustrate states of the above mentioned components of the fuel system across three durations: a first duration from time t0 to time t1; a second duration from time t1 to time t2; and a third duration from time t2 to time 13.

At time t0, the refueling valve and the bellows sealing valve are in an OPEN position (e.g., corresponding to step 702 of method 700 of FIG. 7). The vacuum pump is in an ON position (e.g., from step 612 of method 600 of FIG. 6), where air is being drawn by the vacuum pump from the fuel tank, thereby inducing a vacuum in the fuel tank (e.g., the target vacuum). At time t0, the pressure detected by the in-tank pressure sensor is an atmospheric pressure for each of scenarios 1, 2, and 3.

Over the first duration from t0 to t1, plot 812 shows a pressure that decreases from atmospheric pressure to the target vacuum. Under this scenario (e.g., scenario 1), the target vacuum is achieved at t1, and as a result it may be concluded that no large degradations exist in either the fuel tank or the bellows. In contrast, over the first duration from t0 to t1, plots 808 and 810 shows a pressure that does not decrease from atmospheric pressure to the target vacuum as the vacuum pump draws air out of the fuel tank, indicating that air is entering the fuel tank via a degradation. Under these scenarios (e.g., scenarios 2 and 3), the target vacuum is not achieved at t1, and as a result it may be concluded that a large degradation exists, either in the fuel tank or the bellows.

At time t1, the bellows sealing valve is adjusted to a CLOSED position (e.g., corresponding to step 716 of method 700 of FIG. 7). The refueling valve remains OPEN, and the vacuum pump remains in an ON state, where air is being drawn by the vacuum pump from the fuel tank, thereby inducing a vacuum in the fuel tank. At time t1, the pressure detected by the in-tank pressure sensor in scenarios 2 and 3 is atmospheric pressure.

Over the second duration from t1 to t2, plot 808 shows a pressure that decreases from atmospheric pressure to the target vacuum. Under this scenario (e.g., scenario 3), the target vacuum is achieved at t2, and as a result it may be concluded that a large degradation exists in the bellows, since sealing the bellows via the closed bellows sealing valve allows eliminates an effect of the degradation. In contrast, over the second duration from t1 to t2, plot 810 shows a pressure that does not decrease from atmospheric pressure to the target vacuum as the vacuum pump draws air out of the fuel tank, indicating that air is entering the fuel tank not via the bellows, but via a degradation in the fuel tank. Since the target vacuum is not achieved after closing the bellows sealing valve (e.g., which eliminates the effect of a degradation in the bellows), as a result it may be concluded that a large degradation exists in the fuel tank. Over the third duration from t2 to t3, the pressure measurements made by the in-tank pressure sensor under scenarios 1, 2, and 3 remain unchanged from t2 to t3, and the diagnostic procedure for distinguishing between a large degradation in the fuel tank or a large degradation in the bellows ends.

Figure 9:
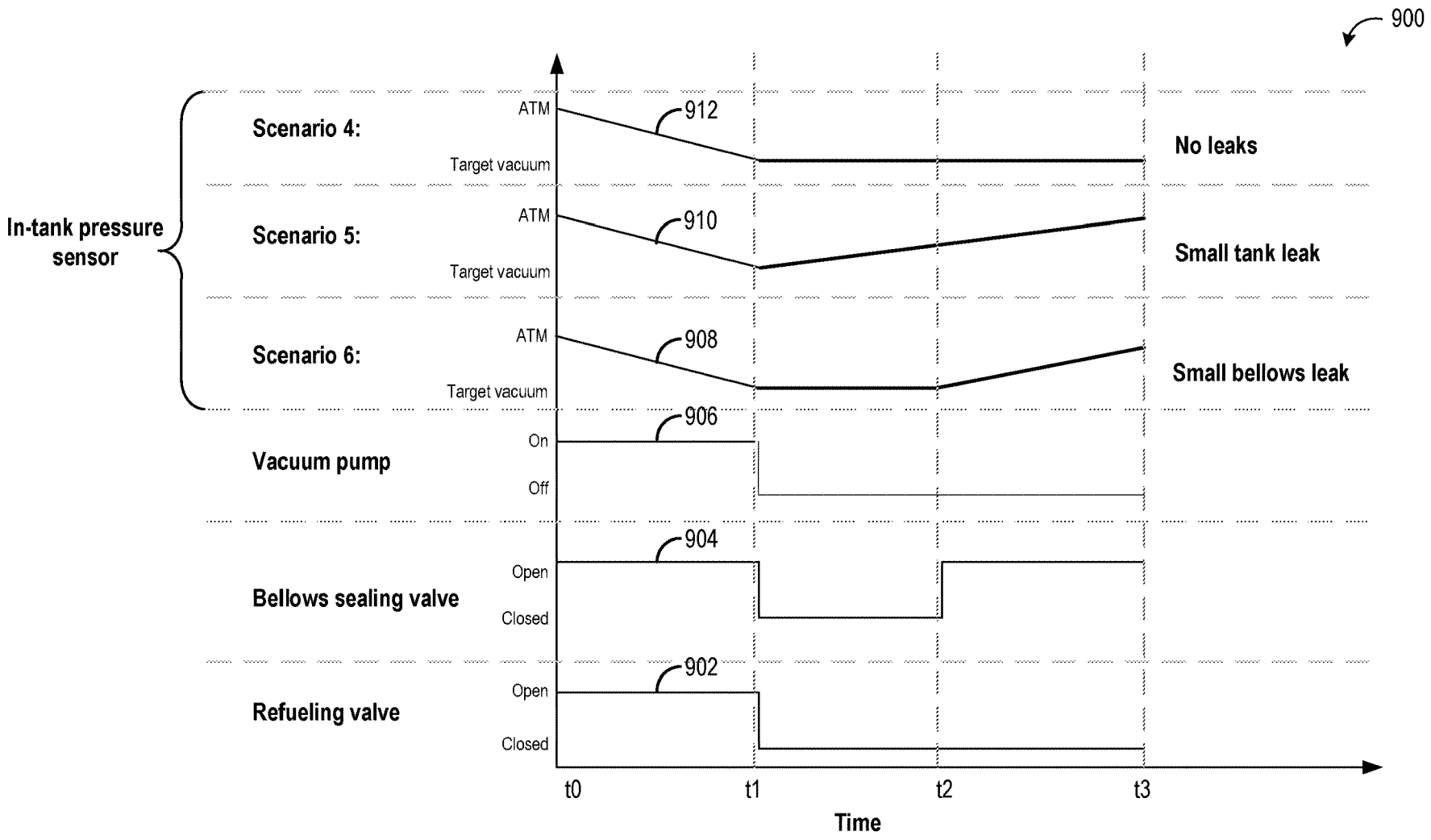
FIG. 9 is a timing diagram of a diagnostics routine for a fuel system.

Referring now to FIG. 9, a timing diagram 900 is shown that illustrates a sequence of actions performed within a diagnostic procedure for distinguishing a small degradation in a bellows from a small degradation in a fuel tank of a fuel system of a HEV vehicle. The diagnostic procedure may be the same as or similar to the procedure described above in reference to steps 716-730 of method 700. The bellows and the fuel tank of the fuel system of the vehicle may be the same as or similar to the bellows 272 of the fuel tank 220 of the fuel system 218 of FIG. 2 and/or the bellows 564 of the fuel tank 550 of FIG. 5B. Instructions for performing the actions described in method 900 may be executed by a controller (e.g., the controller 212 of control system 214 of FIG. 2) based on instructions stored on a memory of the controller and in conjunction with signals received from sensors of the vehicle propulsion system, such as the sensors described above in relation to the vehicle propulsion system 100 of FIG. 1.

Similar to timing diagram 800, timing diagram 900 shows plots 902, 904, 906, 908, 910, and 912, which illustrate states of components of the fuel system over time. Plot 902 indicates a state of a refueling valve of the fuel system (e.g., the FTIV of the fuel system 218 of FIG. 2), which may be in an OPEN position or a CLOSED position. Plot 904 indicates a state of a bellows sealing valve (e.g., the bellows sealing valve 285 of the fuel system 218 of FIG. 2), which may be in an OPEN position or a CLOSED position. Plot 906 indicates a state of a vacuum pump, which may be in an ON state or an OFF state. Plots 908, 910, and 912 show pressure measurements outputted by an in-tank pressure sensor over time (e.g., the in-tank pressure sensor 273 of the fuel system 218 of FIG. 2), where plot 912 shows pressure measurements outputted by the in-tank pressure sensor under a fourth scenario (e.g., no degradations), plot 910 shows pressure measurements outputted by the in-tank pressure sensor under a fifth scenario (e.g., a small tank degradation), and plot 908 shows pressure measurements outputted by the in-tank pressure sensor under a sixth scenario (e.g., a small bellows degradation). In accordance with one example, the pressure measurements reflected in plots 908, 910, and 912 fall within a pressure range as indicated on the vertical axis, where the highest pressure reflected is atmospheric pressure, and the lowest pressure reflected is a target vacuum (e.g., the target vacuum described in methods 600 and 700).

Plots 902, 904, 906, 908, 910, and 912 illustrate states of the above mentioned components of the fuel system across three durations: a first duration from time t0 to time t1; a second duration from time t1 to time t2; and a third duration from time t2 to time 3. Thus, plots 902-912 occur over the same time period shown for the plots 802-812 of FIG. 8.

As described above in relation to FIG. 8, at time t0, the refueling valve and the bellows sealing valve are in an OPEN position (e.g., corresponding to step 702 of method 700 of FIG. 7). The vacuum pump is in an ON position (e.g., from step 612 of method 600 of FIG. 6), where air is being drawn by the vacuum pump from the fuel tank, thereby inducing a vacuum in the fuel tank (e.g., the target vacuum). At time t0, the pressure detected by the in-tank pressure sensor is an atmospheric pressure for each of scenarios 4, 5, and 6.

In contrast to scenarios 1, 2, and 3 of FIG. 8, over the first duration from t0 to t1, plots 912, 910, and 908 all show a pressure that decreases from atmospheric pressure to the target vacuum. Thus, for scenarios 4, 5, and 6, it is determined by time t1 that no large degradations are present in either the fuel tank or the bellows, because under scenarios 4, 5, and 6 a target vacuum is achieved at t1. To determine whether a small degradation exists in either the bellows or the fuel tank, at t1 the refueling valve is adjusted to a CLOSED position and the bellows sealing valve is adjusted to a CLOSED position, thereby sealing the fuel tank from the atmosphere. At time t1, the pressure in the fuel tank is the target vacuum for each of scenarios 4, 5, and 6, and the vacuum pump is adjusted to an OFF position.

Over the second duration from t1 to t2, plot 910 shows a gradual pressure increase from the target vacuum to atmospheric pressure. Under this scenario (e.g., scenario 5), the target vacuum is not maintained at t2, and as a result it may be concluded that a small degradation condition is present in the fuel tank, since with the fuel tank and bellows sealed to the atmosphere, the pressure inside the fuel tank would be unaffected by a degradation in the bellows. In contrast, over the second duration from t1 to t2, plots 908 and 912 show a pressure that does not increase from the target vacuum to atmospheric pressure over time. However, as the bellows and fuel tank are sealed to the atmosphere, a degradation may still be present and undetected in the bellows.

To determine whether a degradation condition is present in the bellows, at t2 the bellows sealing valve is opened, thereby allowing air to enter the bellows. Over the third duration from t2 to 13, plot 912 indicates that the pressure measurements made by the in-tank pressure sensor under scenario 4 remain unchanged from t2 to t3, indicating that allowing air to enter the bellows does not have an effect on the pressure inside the fuel tank, whereby it may be concluded that no degradations exist in either the fuel tank or the bellows. Alternatively, plot 908 shows a gradual increase in pressure from the target vacuum to atmospheric pressure over the third duration from t2 to t3, indicating that air is flowing through the bellows valve and through a degradation in the bellows into the fuel tank. Therefore, under scenario 6 it may be concluded that a small degradation condition is present in the bellows.

Thus, by adjusting the refueling valve to a CLOSED position and measuring the pressure of the fuel tank with the bellows sealing valve alternatively OPEN and CLOSED, a diagnostic procedure may determine whether a degradation in the fuel system may be attributed to a bleedup of air from the bellows to the fuel tank, or a bleedup of air from the atmosphere to the fuel tank, and as a result, a degradation in the bellows may be distinguished from a degradation in the fuel tank.

In this way, for a fuel system of a PHEV that includes a fuel tank with a variable volume device, a degradation detection method is provided whereby a degradation in the variable volume device may be both detected and distinguished from a degradation in the fuel tank. As a result, a release of evaporative emissions from the variable volume device to the atmosphere during a pressure buildup due to diurnal temperature fluctuations may be avoided, and compliance with emissions regulations may be ensured. An additional advantage of the degradation detection method disclosed herein is that by implicating a leaky bellows, a costly replacement of a fuel tank due to a degradation condition may be avoided. Further, with the exception of a new low-pressure bellows sealing valve, the degradation detection method relies on existing components of the fuel system, thereby reducing a cost of implementation.

FIGS. 2 and 4 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The technical effect of the degradation detection routine described herein is that a degradation condition in a variable volume device of a fuel system of a HEV vehicle may be distinguished from a degradation condition in a fuel tank of the fuel system of the HEV vehicle. Further, the degradation detection routine may rely on existing elements of the fuel system, thereby reducing a cost of the fuel system.

An example provides for a diagnostic method for a vehicle with a valve and a fuel tank having a variable volume device internal to the tank, including operating the fuel tank over a diurnal cycle; differentiating between degradation of the fuel tank and the variable volume device based on a fuel tank pressure at a plurality of different valve conditions; and indicating the differentiated degradation. In a first example of the method, differentiating between degradation of the fuel tank and the variable volume device includes generating a vacuum in a fuel tank; closing a valve coupled to a variable volume device; measuring a pressure of the fuel tank after the valve is closed; and responsive to a change in the fuel tank pressure, distinguishing between a first degradation in the variable volume device and a first degradation in the fuel tank. In a second example of the method, which optionally includes the first example, distinguishing between a first degradation in the variable volume device and a first degradation in the fuel tank includes, responsive to a decrease in the pressure of the fuel tank, indicating a first degradation in the variable volume device; and responsive to a maintaining of the pressure in the fuel tank, indicating a first degradation in the fuel tank. In a third example of the method, which optionally includes one or both of the first and second examples, differentiating between degradation of the fuel tank and the variable volume device includes generating a vacuum in a fuel tank; closing a refueling valve of the fuel tank; closing the valve coupled to a variable volume device; measuring a pressure of the fuel tank after the refueling valve and the valve coupled to the variable volume device are closed; and responsive to a change in the fuel tank pressure, distinguishing between a second degradation in the variable volume device and a second degradation in the fuel tank, where the second degradation is smaller than the first degradation. In a fourth example of the method, which optionally includes one or more of each of the first through third examples, distinguishing between a second degradation in the variable volume device and a second degradation in the fuel tank includes, responsive to an increase in the pressure of the fuel tank, indicating a second degradation in the fuel tank. In a fifth example of the method, which optionally includes one or more of each of the first through fourth examples, distinguishing between a second degradation in the variable volume device and a second degradation in the fuel tank includes, responsive to an increase in the pressure of the fuel tank, indicating a second degradation in the fuel tank. In a sixth example of the method, which optionally includes one or more of each of the first through fifth examples, distinguishing between a second degradation in the variable volume device and a second degradation in the fuel tank further includes opening the valve coupled to the variable volume device; and, responsive to an increase in the pressure of the fuel tank, indicating a second degradation in the variable volume device. In a seventh example of the method, which optionally includes one or more of each of the first through sixth examples, the fuel tank pressure is measured via a pressure sensor inside the fuel tank. In an eighth example of the method, which optionally includes one or more of each of the first through seventh examples, the refueling valve connects the fuel tank with a vapor line of an evaporative emissions control system. In a ninth example of the method, which optionally includes one or more of each of the first through eighth examples, the fuel tank pressure is measured via a fuel tank pressure transducer arranged on the vapor line. In a tenth example of the method, which optionally includes one or more of each of the first through ninth examples, the variable volume device is a bellows. In an eleventh example of the method, which optionally includes one or more of each of the first through tenth examples, the bellows is internally sealed from the fuel tank. In a twelfth example of the method, which optionally includes one or more of each of the first through eleventh examples, a degradation in the fuel tank is distinguished from a degradation in an end of the bellows. In a thirteenth example of the method, which optionally includes one or more of each of the first through twelfth examples, a degradation in the fuel tank is distinguished from a degradation in a side of the bellows.

An example provides for a method for a vehicle with a valve and a fuel tank having a variable volume device internal to the tank, including determining degradation of the variable volume device based on a fuel tank pressure at a plurality of different valve conditions; and indicating the degradation.

An example provides for a system for a vehicle, including a fuel tank having a bellows internal to the tank; a valve coupled to the bellows external to the tank; a pressure sensor of the fuel tank; and a controller, storing instructions in non-transitory memory that, when executed, cause the controller to close the valve coupled to the bellows; measure a first fuel tank pressure after the valve is closed; determine a first degradation condition in the fuel tank based on the measured first fuel tank pressure; open the valve coupled to the bellows; measure a second fuel tank pressure after the valve is open; and determine a second degradation condition in the bellows based on the measured second fuel tank pressure. In a first example of the system, the fuel tank is a NIRCOS fuel tank. In a second example of the system, which optionally includes the first example, the valve coupled to the bellows connects the fuel tank with the atmosphere. In a third example of the system, which optionally includes one or both of the first and second examples, a level of fuel of the fuel tank is measured via a fuel level sensor, and performing the method is conditioned on the level of fuel of the fuel tank being below a threshold level. In a fourth example of the system, which optionally includes one or more of each of the first through third examples, a duration is measured, and performing the method is conditioned on the duration exceeding a threshold duration. In a fifth example of the system, which optionally includes each of the first through the fourth examples, the vehicle is a HEV.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A diagnostic method for a vehicle with a fuel system including a fuel tank having a variable volume device internal to the fuel tank, comprising:

operating the fuel tank over a diurnal cycle;

differentiating between a first type of degradation and a second type of degradation of the fuel system, and further differentiating between degradation of the fuel tank and the variable volume device based on a fuel tank pressure at a plurality of different conditions of a sealing valve coupled to the variable volume device and/or a refueling valve coupled to the fuel tank; and indicating the differentiated degradation.

2. The method of claim 1, wherein differentiating between the first type of degradation and the second type of degradation includes:

applying a vacuum to the fuel tank;

upon a target vacuum not being reached within a time period, indicating the first type of degradation, and distinguishing between degradation of the fuel tank and degradation of the variable volume device by:

closing the sealing valve while applying the vacuum and with the refueling valve open;

measuring the fuel tank pressure after the sealing valve is closed; and distinguishing between degradation of the fuel tank and degradation of the variable volume device based on the measured fuel tank pressure.

3. The method of claim 2, wherein distinguishing between degradation of the fuel tank and degradation of the variable volume device based on the measured fuel tank pressure includes:

responsive to the measured fuel tank pressure decreasing, indicating degradation of the variable volume device; and responsive to the measured fuel tank pressure being maintained, indicating a first degradation of the fuel tank.

4. The method of claim 3, wherein differentiating between the first type of degradation and the second type of degradation includes:

applying vacuum to the fuel tank;

upon the target vacuum being reached within the time period, indicating the second type of degradation, and distinguishing between degradation of the fuel tank and degradation of the variable volume device by:

closing the refueling valve and closing the sealing valve;

measuring the fuel tank pressure after the refueling valve and the sealing valve are closed; and distinguishing between degradation of the fuel tank and degradation of the variable volume device based on the measured fuel tank pressure, where the second type of degradation includes a smaller leak than the first type of degradation.

5. The method of claim 4, wherein distinguishing between degradation of the fuel tank and degradation of the variable volume device based on the measured fuel tank pressure includes:

responsive to the measured fuel tank pressure increasing with both the refueling valve and the sealing valve closed, indicating degradation of the fuel tank.

6. The method of claim 5, wherein distinguishing between degradation of the fuel tank and degradation of the variable volume device based on the measured fuel tank pressure further includes:

opening the sealing valve;

responsive to the measured fuel tank pressure increasing with the sealing valve open and the refueling valve closed, indicating degradation of the variable volume device.

7. The method of claim 1, wherein the fuel tank pressure is measured via a pressure sensor inside the fuel tank.

8. The method of claim 4, wherein the refueling valve connects the fuel tank with a vapor line of an evaporative emissions control system.

9. The method of claim 8, wherein the fuel tank pressure is measured via a fuel tank pressure transducer arranged on the vapor line.

10. The method of claim 1, wherein the variable volume device is a bellows.

11. The method of claim 10, wherein the bellows is internally sealed from the fuel tank.

12. A method for a vehicle with a valve and a fuel tank having a variable volume device internal to the tank, comprising:

determining degradation of the variable volume device based on a fuel tank pressure at a plurality of different valve conditions, including determining whether the degradation of the variable volume device is a first type of degradation or a second type of degradation based on a change in the fuel tank pressure when a vacuum is applied to the fuel tank and the valve is moved from open to closed; and indicating the degradation.

13. A system for a vehicle, comprising:

a fuel tank having a bellows internal to the tank;

a valve coupled to the bellows external to the tank;

a pressure sensor of the fuel tank;

a controller, storing instructions in non-transitory memory that, when executed, cause the controller to:

apply a vacuum to the fuel tank;

close the valve coupled to the bellows and seal the fuel tank;

measure a first fuel tank pressure after the valve is closed and the fuel tank is sealed;

determine a first degradation condition of the fuel tank based on the measured first fuel tank pressure;

open the valve coupled to the bellows while the fuel tank is sealed;

measure a second fuel tank pressure after the valve is open;

determine a second degradation condition of the bellows based on the measured second fuel tank pressure.

14. The system of claim 13, wherein the vehicle is a hybrid electric vehicle (HEV) and the fuel tank is a non-integrated refueling canister only system (NIRCOS) fuel tank.

15. The system of claim 13, wherein the valve coupled to the bellows connects the bellows with the atmosphere.

16. The system of claim 13, wherein a level of fuel of the fuel tank is measured via a fuel level sensor, and wherein the vacuum is applied responsive to the level of fuel of the fuel tank being below a threshold level.

17. The system of claim 13, wherein a duration since a prior degradation determination is measured, and wherein the vacuum is applied responsive to the duration exceeding a threshold duration.

18. The method of claim 1, wherein differentiating between the first type of degradation and the second type of degradation of the fuel system, and further differentiating between degradation of the fuel tank and the variable volume device based on the fuel tank pressure at the plurality of different conditions comprises:

determining if the fuel tank or the variable volume device is exhibiting the first type of degradation based on the fuel tank pressure at a first condition where the sealing valve is open and the refueling valve is open and at a second condition where the sealing valve is closed and the refueling valve is open; and determining if the fuel tank or the variable volume device is exhibiting the second type of degradation based on the fuel tank pressure at a third condition where the sealing valve is closed and the refueling valve is closed and at a fourth condition where the sealing valve is open and the refueling valve is closed.

19. The method of claim 12, wherein determining whether the degradation of the variable volume device is a first type of degradation or a second type of degradation based on a change in the fuel tank pressure when a vacuum is applied to the fuel tank and the valve is moved from open to closed comprises:

determining that the degradation of the variable volume device is the first type of degradation responsive to the fuel tank pressure decreasing to a target pressure after the valve is closed and while vacuum is applied to the fuel tank; and determining that the degradation of the variable volume device is the second type of degradation responsive to the fuel tank pressure being maintained at the target pressure after the valve is closed and while vacuum is applied to the fuel tank, and further responsive to the fuel tank pressure increasing from the target pressure toward atmospheric pressure after the valve is moved from closed to open while vacuum is not applied to the fuel tank.

* * * * *